US010947977B2

(12) United States Patent
Wang

(10) Patent No.: US 10,947,977 B2
(45) Date of Patent: Mar. 16, 2021

(54) ANTI-LOCKING MECHANISM OF SPHERICAL COMPRESSOR ROTOR

(71) Applicant: Shenzhen Zhongke Zheng'an Science & Technology Partnership Enterprise (limited partnership), Guangdong (CN)

(72) Inventor: Luyi Wang, Xi'an (CN)

(73) Assignee: Shenzhen Zhongke Zheng'an Science & Technology Partnership Enterprise (limited partnership), Shenzhen (CN)

( * ) Notice: Subject to any disclaimer, the term of this patent is extended or adjusted under 35 U.S.C. 154(b) by 91 days.

(21) Appl. No.: 16/392,423

(22) Filed: Apr. 23, 2019

(65) Prior Publication Data

US 2019/0249669 A1 Aug. 15, 2019

Related U.S. Application Data

(60) Division of application No. 15/222,953, filed on Jul. 29, 2016, now Pat. No. 10,316,844, and a (Continued)

(30) Foreign Application Priority Data

Mar. 18, 2014 (CN) ..... 201410100390.X
Oct. 19, 2014 (CN) ..... 201410554836.6

(51) Int. Cl.
*F04C 18/54* (2006.01)
*F04C 29/00* (2006.01)
*F04C 3/08* (2006.01)

(52) U.S. Cl.
CPC ..... *F04C 29/0057* (2013.01); *F04C 18/54* (2013.01); *F04C 29/0042* (2013.01); (Continued)

(58) Field of Classification Search
CPC .. F04C 29/0057; F04C 18/54; F04C 29/0042; F04C 3/085; F04C 3/08
See application file for complete search history.

(56) References Cited

U.S. PATENT DOCUMENTS 3,101,700 A * 8/1963 Bowdish ..... F04C 18/54 418/195
4,441,869 A * 4/1984 Larsen ..... F01C 9/005 418/51

(Continued)

*Primary Examiner* — Deming Wan

(57) ABSTRACT

An anti-locking mechanism of a spherical compressor rotor, an anti-locking power mechanism of a spherical compressor, and a spherical compressor. A pin boss is fixedly arranged on a turntable shaft, and guide pins are movably connected with a guide sleeve. A concave slideway is arranged in a cylinder block spherical surface or a cylinder lower spherical surface, and is distributed along a sliding track of the guide sleeve on the corresponding cylinder block spherical surface or cylinder lower spherical surface in a rotation process of a turntable. A main shaft rotates and drives the turntable. When the turntable rotates to a position at which a turntable axis and a piston axis are superposed, the turntable can continue to rotate around the turntable axis by means of torque obtained by the guide pin from the concave slideway, and thus a problem of a dead point of movement of a spherical compressor rotor is solved. Because the concave slideway is arranged outside a spherical working cylinder of a spherical compressor, the sealing effect is good.

4 Claims, 34 Drawing Sheets

Related U.S. Application Data continuation of application No. PCT/CN2015/073501, filed on Mar. 2, 2015.

(52) U.S. Cl.
CPC ..... *F04C 2240/20* (2013.01); *F04C 2240/30* (2013.01); *F04C 2240/60* (2013.01); *F04C 2250/20* (2013.01)

(56) References Cited

U.S. PATENT DOCUMENTS

| | | | | |
|---|---|---|---|---|
| 8,777,595 | B2 * | 7/2014 | Arnold | F01C 3/08 417/410.4 |
| 9,670,778 | B2 * | 6/2017 | Amesoeder | F01C 21/18 |
| 2012/0189479 | A1 * | 7/2012 | Wang | F04C 18/54 418/5 |

* cited by examiner

E-E

ANTI-LOCKING MECHANISM OF SPHERICAL COMPRESSOR ROTOR

CROSS-REFERENCE TO RELATED APPLICATIONS

This application is a divisional application of U.S. Ser. No. 15/222,953, filed on Jul. 29, 2016, which is a continuation of International Patent Application No. PCT/CN2015/073501 with a filing date of Mar. 2, 2015, designating the United States, now pending, and further claims priority to Chinese Patent Application No. 201410100390.X with a filing date of Mar. 18, 2014, and Chinese Patent Application No. 201410554836.6 with a filing date of Oct. 19, 2014. The content of the aforementioned applications, including any intervening amendments thereto, are incorporated herein by reference.

TECHNICAL FIELD

The present invention relates to a spherical compressor, and particularly relates to an anti-locking mechanism of a spherical compressor rotor, an anti-locking power mechanism of a spherical compressor, and a spherical compressor.

BACKGROUND OF THE PRESENT INVENTION

The spherical compressor technology is a new subject developed in recent years. The structure and the principle of the spherical compressor are completely different from those of the existing compressor. In the spherical compressor, a piston and a turntable which are arranged in a spherical inner cavity are driven by the rotation of a main shaft to make relative movement. A pair of or multiple pairs of working chambers continuously variable in volume are formed in the space to generate compression and expansion. The spherical compressor technology is greatly developed and widely used due to its increasing development and improvement in recent years. The spherical compressor has the advantages of no intake/exhaust valve, fewer movement parts, small vibration, high mechanical efficiency, reliability in sealing and the like. Its advantages in the field of micro compressors and high-compression-ratio pump-type machinery are more apparent. At present, the spherical compressor technology has already achieved multiple patents both in China and abroad; however, when the main shaft rotates to a position at which the turntable axis and the piston axis are superposed, a dead point of movement of the mechanism is generated, thereby easily resulting in locking and incapable rotation of the mechanism; and particularly under the working condition of small structural size, poor lubrication and high pressure ratio, the locking phenomenon is more apparent.

The specific reasons for the locking of a rotor are analyzed as follows:

Because the rotation of the piston is driven by an eccentric main shaft, when the main shaft rotates to a position at which the turntable axis and the piston axis are superposed, a resultant force generated by the main shaft on a turntable is perpendicularly intersected with the axes of the piston and the turntable, and the force generated by the main shaft on the turntable cannot generate the torque component driving the piston and the turntable to rotate along respective axes at this position and cannot drive the piston and the turntable to rotate. This is called the movement dead point of the mechanism. Analysis on the stress is as follows: the main shaft is driven by a motor to rotate, the main shaft generates a driving force on the turntable, and a component force of the driving force enables the piston and the turntable to rotate along respective axes; when the piston and the turntable rotate to a position nearby the position at which the axis of the turntable and the axis of the piston are superposed, the torque generated by the component force enabling the piston and the turntable to rotate is smaller and smaller until being zero; consequently, when the piston axis and the turntable axis are approximately superposed, the piston and the turntable cannot obtain sufficient torque to rotate along respective axes, so that the rotation of the piston and the turntable is locked nearby this position, and a movement dead point of the mechanism is generated; and when the movement dead point is at a starting state or the rotation is stopped at the state, the piston and the turntable cannot be started at next time.

The patent with the patent number of ZL201310100697.5 and the name of "a turntable rotation synchronizing mechanism for a spherical compressor" provides a technical solution: a turntable rotation synchronizing mechanism is arranged between a turntable spherical surface and a matched cylinder inner spherical surface, so that when the turntable rotates to the position at which the turntable axis and the piston axis are superposed, at the moment when the torque obtained by the turntable from the main shaft is zero, the torque generated by the synchronizing mechanism can still enable the turntable to move continuously; and therefore, the turntable is unlikely to lock, and the dead point problem of the movement of the spherical compressor mechanism is fundamentally solved. However, an adverse effect is that since the turntable synchronizing mechanism is arranged between the turntable spherical surface and the cylinder inner spherical surface, a concave slideway arranged on the matched spherical surfaces reduces the sealing area, and even becomes a gas leakage passage between the working chambers, so that the surface sealing advantage of the spherical compressor is alleviated, the spherical compressor cannot work under the working condition of the micro structure at high pressure, and the efficiency is decreased.

SUMMARY OF PRESENT INVENTION

One object of the present invention is to design an anti-locking mechanism of a spherical compressor rotor on the basis of the Chinese patent ZL201310100697.5, so that when the turntable rotates to a position at which the turntable axis and the piston axis are superposed, i.e. at the dead point position of the compressor rotor, and when the main shaft rotates and drives the turntable, the anti-locking mechanism can generate a torque making the turntable rotate continuously around the turntable axis, and the rotor rotates continuously and crosses the dead point, thereby thoroughly solving the problems that the leakage caused by the original turntable synchronizing mechanism is increased and the efficiency is relatively low when the spherical compressor is small in structural size and high in pressure.

Another object of the present invention is to design an anti-locking power mechanism of a spherical compressor, so that when the turntable rotates to a position at which the turntable axis and the piston axis are superposed, i.e. at the dead point position of the compressor rotor, the main shaft rotates and drives the turntable, a turntable synchronizing power mechanism can generate power making the turntable rotate continuously around the turntable axis, and the rotor rotates continuously and crosses the dead point; and meanwhile, by virtue of improved design, the local imbalance pressure generated by the turntable spherical surface and the cylinder spherical surface due to the operation of the compressor is reduced, thereby thoroughly solving the locking problem of the spherical compressor rotor.

In order to achieve the above objects, on one hand, the present invention provides an anti-locking mechanism of a spherical compressor rotor; a cylinder block is fixedly connected between a cylinder and a main shaft support, and a cylinder block spherical surface, a cylinder lower spherical surface and a turntable spherical surface have a same spherical center; the spherical diameter of the cylinder block spherical surface is greater than that of the cylinder lower spherical surface, and a spherical rotating body space surrounding a turntable shaft is formed between a cylinder and the cylinder block; the turntable shaft penetrates through a cylinder shaft hole and a cylinder block shaft hole, and the end part of the turntable shaft is inserted into an eccentric shaft hole of a main shaft; a pin boss is fixed on the turntable shaft and rotates in the spherical rotating body space along with the turntable shaft, guide pins are fixedly arranged on the pin boss, and an extension portion of each guide pin is movably connected with a guide sleeve; a concave slideway is arranged on the cylinder block spherical surface or the cylinder lower spherical surface, and is distributed along a sliding track of the guide sleeve on the corresponding cylinder block spherical surface or cylinder lower spherical surface in a rotation process of the turntable; and the guide sleeve is arranged in the concave slideway, and the cross sectional shape of the concave slideway is matched with the shape of the guide sleeve.

The guide sleeve is arranged at one side of the cylinder block on the pin boss, and the concave slideway is arranged on the cylinder block spherical surface.

The guide sleeve is arranged at one side of the cylinder on the pin boss, and the concave slideway is arranged on the cylinder lower spherical surface.

The pin boss is in an arc shape, and two guide pins are arranged at two sides of the pin boss symmetrically by adopting the turntable shaft as a symmetric shaft.

Compared with the prior art, the anti-locking mechanism of the spherical compressor rotor provided in the present invention has the following characteristics and advantages:

When the turntable rotates to a position at which the turntable axis and the piston axis are superposed, at the moment when the torque obtained by the turntable from the main shaft and making the turntable rotate is zero, and when the main shaft drives the turntable, a contact force generated by the guide pins and the concave slideway can still make the turntable move continuously, so that the turntable is unlikely to lock, and thus a problem of a dead point of movement of a spherical compressor mechanism is solved fundamentally; and moreover, since the concave slideway is arranged outside a spherical operating cylinder of the spherical compressor, the pressure leakage and the formation of a pressure leakage passage in a spherical cavity are avoided, and the sealing is facilitated, thereby being applicable to small-sized and micro compressors and high pressure occasions, and improving the working efficiency of the compressor.

On the other hand, the present invention provides an anti-locking power mechanism of a spherical compressor; a cylinder block is fixedly connected between a cylinder and a main shaft support; a cylinder block bushing is arranged on the matched portion of the cylinder block and the main shaft, a turntable shaft penetrates through a cylinder shaft hole and a cylinder block shaft hole, and the end part of the turntable shaft is inserted into an eccentric shaft hole of the main shaft; a turntable synchronizing power mechanism composed of a power handle and a track limiting surface is arranged between the cylinder and the cylinder block; the power handle is a dumbbell-shaped structure with two symmetric ends; the power handle is fixed on the turntable shaft and rotates along with the turntable, and in the rotation process, movement track surfaces, contacted with the cylinder block, of two ends of the power handle form a track limiting surface; and the turntable is provided with a backpressure support.

An installation hole is formed in the middle of the power handle; the power handle is fixed on a corresponding installation step on the turntable shaft through the installation hole; two ends of the power handle are fixedly connected with arc slip shoes, and when the power handle rotates, the slip shoes slide in a manner of fitting to the track limiting surface; and the slip shoes are made of PEEK, copper or other elastic wear-resistant materials.

An installation hole is formed in the middle of the power handle; the power handle is fixed on a corresponding installation step on the turntable shaft through the installation hole; two ends of the power handle are provided with pulleys, and the pulleys rotate in a manner of fitting to the track limiting surface.

An installation hole is formed in the middle of the power handle; the power handle is fixed on a corresponding installation step on the turntable shaft through the installation hole; two ends of the power handle are of an arc structure; an insert which is made of PEEK, copper or other elastic wear-resistant materials is arranged on the track limiting surface contacted with two ends of the power handle; and the insert is arranged in a contacted travel range of two ends of the power handle and the track limiting surface when the power handle rotates to a position nearby a dead point of the mechanism.

A turntable shaft installation hole is formed in a portion connected with the turntable shaft on the turntable; the shape of the end, connected with the turntable, of the turntable shaft is a matched installation end, and the installation end of the turntable shaft is inserted into the turntable shaft installation hole and then is circumferentially fixed; the power handle is arranged in the middle part of the turntable shaft, and the power handle and the turntable shaft are manufactured into an integral component; and the other end of the turntable shaft is a circular shaft end and is inserted into an eccentric shaft hole of the main shaft.

Magnetic materials are arranged on two ends of the power handle, a magnetic insert is arranged on the track limiting surface, a clearance is formed between the magnetic insert on the track limiting surface and the magnetic materials on the power handle, and magnetic poles on opposite surfaces are identical; and the magnetic insert is arranged in the approaching travel range of two ends of the power handle and the track limiting surface when the power handle rotates to a position nearby the dead point of the movement.

The track limiting surface may be a whole track or a partial track in which two ends of the power handle are respectively contacted with the cylinder block in the rotation process of the turntable; and if the track limiting surface is the partial track, the partial track can be contacted with two ends of the power handle when the turntable rotates to the position at which the turntable axis and the piston axis are superposed, i.e. at the position of the dead point of the compressor rotor.

A first way for configuring the backpressure support on the turntable is as follows: a backpressure groove is formed in a portion that is always contacted with or fitted to the turntable spherical surface on the cylinder inner spherical surface in the movement process; backpressure air passages which are communicated with each other are formed in a cylinder head and the cylinder; the backpressure air passage on the cylinder head is communicated with an exhaust passage on the cylinder head; the backpressure air passage on the cylinder is communicated with the backpressure groove; high-pressure gas or liquid in the exhaust passage flows into the backpressure groove via the backpressure air passage to form the backpressure support on the turntable spherical surface; and the backpressure groove may be a local groove or a continuous annular groove in the rotation cycle of the turntable.

A second way for configuring the backpressure support on the turntable is as follows: backpressure air passages which are communicated with one another are formed in the cylinder head, the cylinder and the cylinder block, and the backpressure air passage on the cylinder head is connected with an exhaust hole; an outlet of the backpressure air passage on the cylinder block is arranged on the cylinder block inner surface of a rotating space in which the power handle rotates around the turntable shaft; high-pressure gas or liquid discharged from the exhaust hole enters the rotating space of the power handle successively via the backpressure air passages of the cylinder head, the cylinder and the cylinder block; a backpressure supported is formed on the lower part of the turntable; and gas return passages which are communicated with one another are formed in the cylinder block, the cylinder and the cylinder head, an inlet of each gas return passage is arranged in the cylinder block inner surface forming the power handle rotating space on the cylinder block, and an outlet of each gas return passage is communicated with the exhaust hole;

In the first backpressure support way, intake lead-in passages communicated with each other are formed in the cylinder and the cylinder block; an inlet of each intake lead-in passage is arranged in the outer side wall of the cylinder, and an outlet of each intake lead-in passage is communicated with the rotating space of the power handle; intake return passages which are successively communicated with one another are formed in the cylinder block, the cylinder and the cylinder head; an outlet of each intake return passage is connected with an intake hole of the compressor, and an inlet of each intake return passage is communicated with the rotating body space of the power handle; and the intake lead-in passages and the intake return passages on the cylinder block are communicated to a bearing portion at which the main shaft is matched with the cylinder block bushing and a bearing portion at which the main shaft support is matched with the main shaft to form a lubrication and cooling passage of the compressor.

Compared with the prior art, the anti-locking power mechanism of the spherical compressor provided in the present invention has the following characteristics and advantages:

(1) The anti-locking power mechanism of the spherical compressor provided in the present invention fundamentally solves the dead point problem of the movement of the spherical compressor mechanism;

(2) The anti-locking power mechanism of the spherical compressor provided in the present invention can prevent the pressure leakage in the spherical cavity and facilitates the sealing, thereby being applicable to small-sized and micro compressors and high pressure occasions, and increasing the operation efficiency of the compressor;

(3) According to the anti-locking power mechanism of the spherical compressor provided in the present invention, in the structure of the compressor of the same discharge capacity, since the structural size of the slip shoe or the pulley is relatively large, the contact area with the track limiting surface is large, and the carrying capacity is high; the slide friction of the pulley is small, so that the pulley is flexible to move; and the slip shoe is made of the wear-resistant PEEK material or the copper with a self-lubrication function, so that the slide guide effect is good, and the service life is long. Meanwhile, the turntable power synchronizing mechanism is low in machining difficulty and reliable in use;

(4) The anti-locking power mechanism of the spherical compressor provided in the present invention forms the backpressure support on the turntable spherical surface, thereby reducing the local imbalance pressure generated by the turntable spherical surface on the cylinder spherical surface due to the high pressure of a working medium, and reducing the friction force, so that the mechanism is more stable and more reliable to rotate, and the locking of the mechanism is prevented; and (5) The anti-locking power mechanism of the spherical compressor provided in the present invention has a good coolant lubrication effect, increases the efficiency, reduces the friction force, and prevents the mechanism from being locked.

A still another object of the present invention is to design a spherical compressor, so that when the turntable rotates to a position at which the turntable axis and the piston axis are superposed, i.e. at the dead point position of the mechanism, an anti-locking device can generate power enabling the turntable to rotate continuously around its own axis, so that a rotor continues to rotate and crosses the dead point; and meanwhile, by virtue of the improved design, the local imbalance pressure generated by the turntable spherical surface and the cylinder spherical surface due to the operation of the compressor is reduced, so that the locking problem of the spherical compressor rotor is thoroughly solved.

In order to achieve the above object, the present invention provides a spherical compressor, which comprises a cylinder head that is a hollow semi-spherical shell; a piston that is installed in the cylinder head and rotates along its own axis; a cylinder that is a hollow semi-spherical shell and is connected with the cylinder head to form a hollow spherical shell; a turntable that is a semi-spherical body concentric with the cylinder, is embedded inside the cylinder and rotates relative to the cylinder, the piston and the turntable being connected through a cylindrical hinge, and a turntable shaft being arranged at an outer spherical surface center of the turntable; an anti-locking device, one end of the anti-locking device being connected with the cylinder; a main shaft support that is connected with the other end of the anti-locking device; and a main shaft that is installed in the main shaft support and can rotate along its own axis relative to the main shaft support, wherein one end of the main shaft is inserted into the anti-locking device, the end surface of one end of the main shaft is provided with an eccentric shaft hole, and the turntable shaft penetrates through the cylinder and the anti-locking device to be inserted into the eccentric shaft hole; the main shaft rotates and drives the turntable shaft to move; and moreover, when the main shaft drives the turntable shaft to move, the anti-locking device applies an acting force on the turntable shaft, so that the turntable shaft always rotates along its own axis.

Compared with the prior art, the spherical compressor provided in the present invention has the following characteristics and advantages:

(1) The spherical compressor provided in the present invention fundamentally solves the dead point problem of the movement of the mechanism;

(2) The spherical compressor provided in the present invention can prevent the pressure leakage in a spherical cavity and facilitates the sealing, thereby being applicable to small-sized and micro compressors and high pressure occasions, and increasing the operation efficiency of the compressor;

(3) The spherical compressor provided in the present invention forms the backpressure support on the turntable spherical surface, thereby reducing the local imbalance pressure generated by the turntable spherical surface on the cylinder spherical surface due to the high pressure of the working medium, and reducing the friction force, so that the mechanism is more stable and more reliable to rotate, and the locking of the mechanism is prevented; and (4) The spherical compressor provided in the present invention has a good coolant lubrication effect, increases the efficiency, reduces the friction force, and prevents the mechanism from being locked.

DESCRIPTION OF THE DRAWINGS

The drawings described herein are just for the purpose of explanation, not intended to limit the scope disclosed by the present invention by any means. In addition, Shapes, scales, etc. of all components in the drawings are merely schematic and are used for helping to understand the present invention, rather than specifically limiting the shapes and the scales of all components of the present invention. Enlightened by the present invention, those skilled in the art can implement the present invention by selecting various possible shapes and scales according to specific situations.

DETAILED DESCRIPTION OF PREFERRED EMBODIMENTS

The details of the present invention can be understood more clearly in combination with the drawings and the description of the specific embodiments of the present invention. However, the specific embodiments of the present invention described herein are merely used for the purpose of explaining the present invention, rather than understood to limit the present invention by any means. Enlightened by the present invention, those skilled in the art can concept any possible deformations based on the present invention, all of which should be regarded as belonging to the scope of the present invention.

Figure 1:
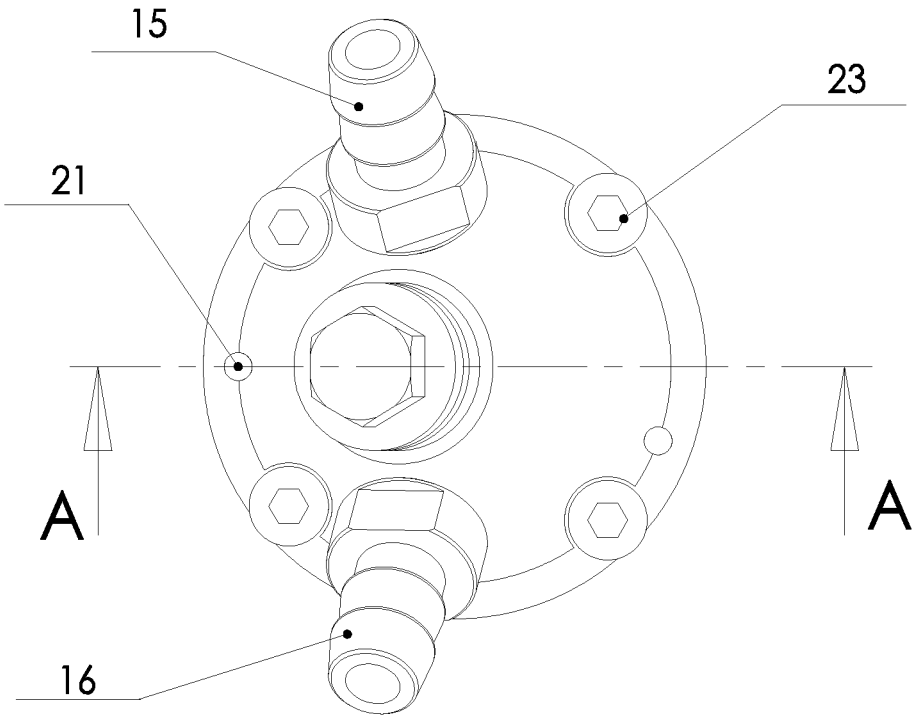
FIG. 1 is a stereoscopic structural diagram of a spherical compressor according to one embodiment of the present invention.
Figure 2:
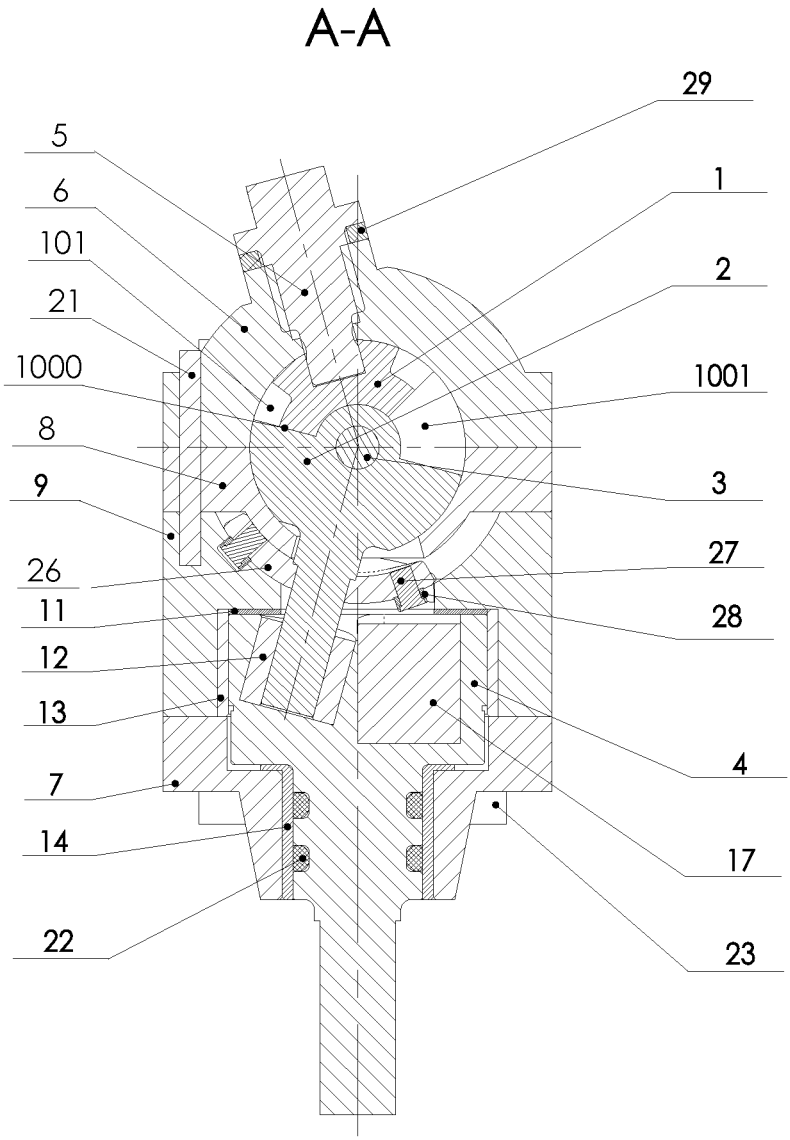
FIG. 2 is a sectional structural diagram of A-A section in a spherical compressor shown in FIG. 1.
Figure 3:
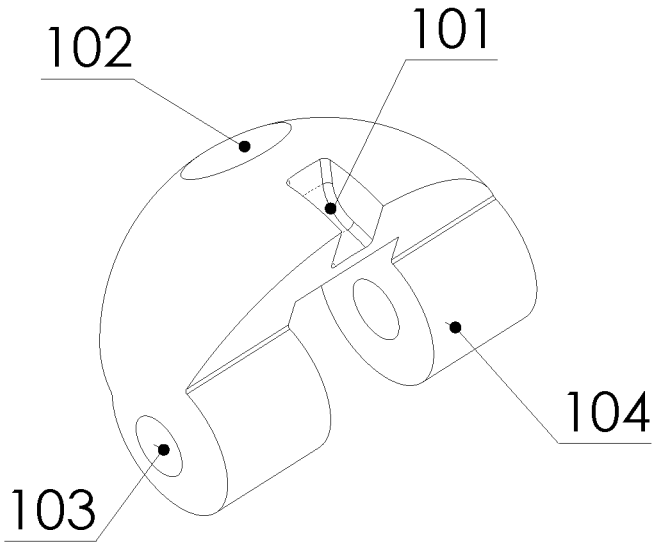
FIG. 3 is a stereoscopic structural diagram of a piston in a spherical compressor shown in FIG. 2.
Figure 5:
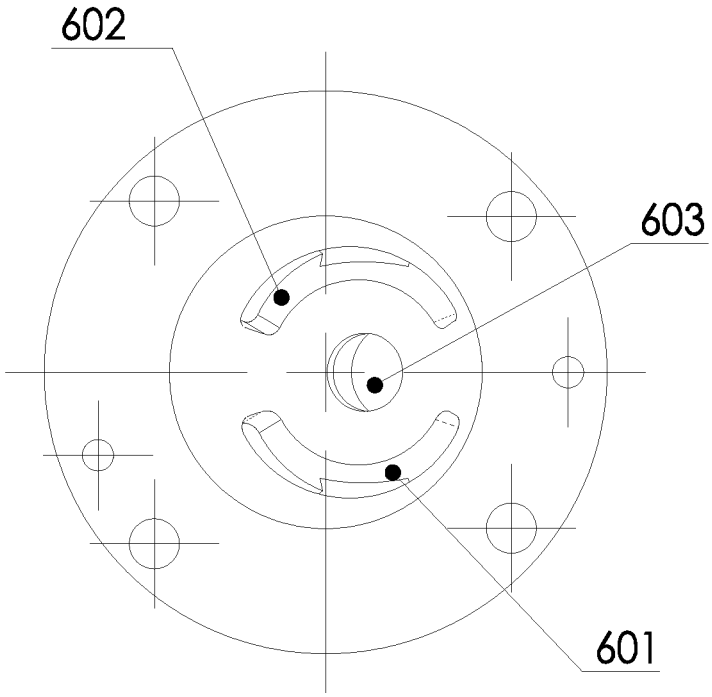
FIG. 5 is a bottom structural diagram of a cylinder head in a spherical compressor shown in FIG. 2.
Figure 6:
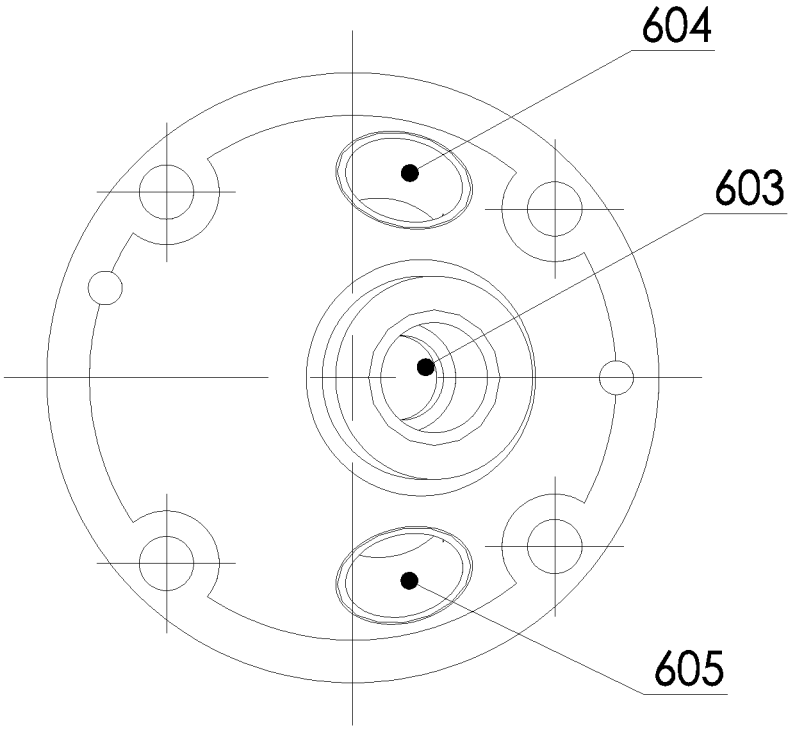
FIG. 6 is a top structural diagram of a cylinder head in a spherical compressor shown in FIG. 2.
Figure 7:
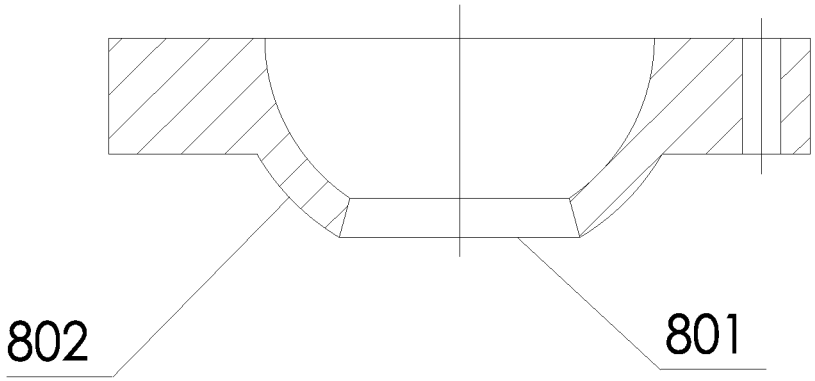
FIG. 7 is a sectional structural diagram of a cylinder in a spherical compressor shown in FIG. 2.
Figure 8:
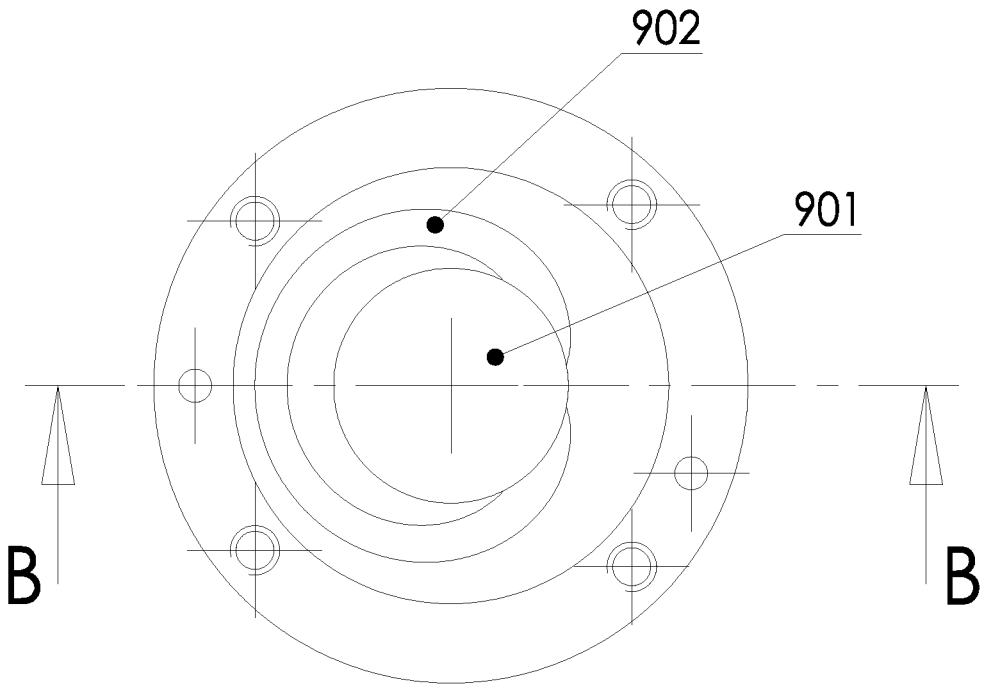
FIG. 8 is a top structural diagram of a cylinder block in a spherical compressor shown in FIG. 2.
Figure 9:
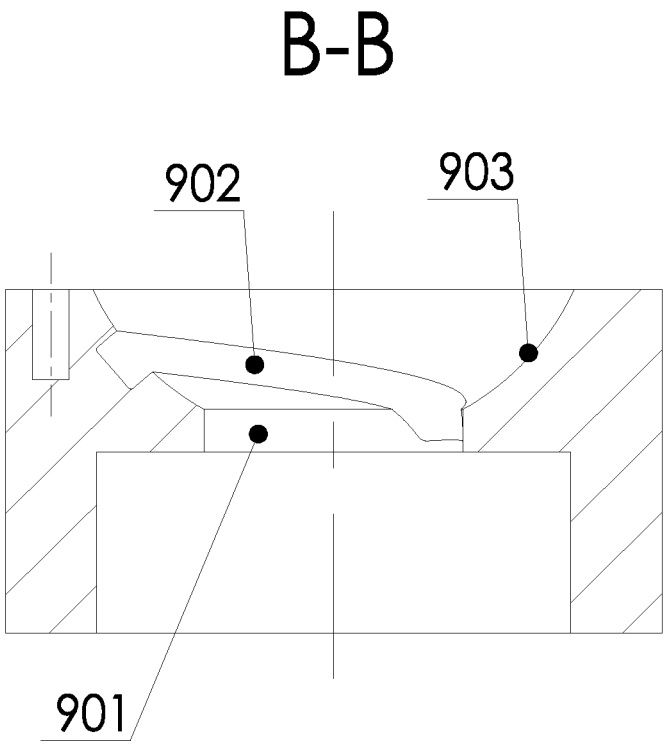
FIG. 9 is a sectional structural diagram of B-B section in a cylinder block shown in FIG. 8.
Figure 16:
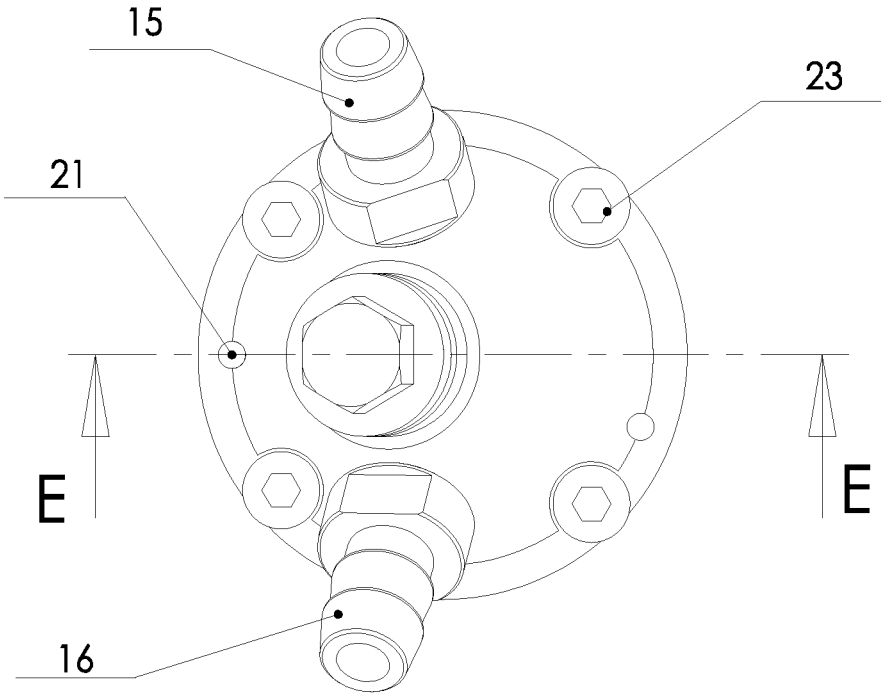
FIG. 16 is a stereoscopic structural diagram of a spherical compressor according to another embodiment of the present invention.
Figure 17:
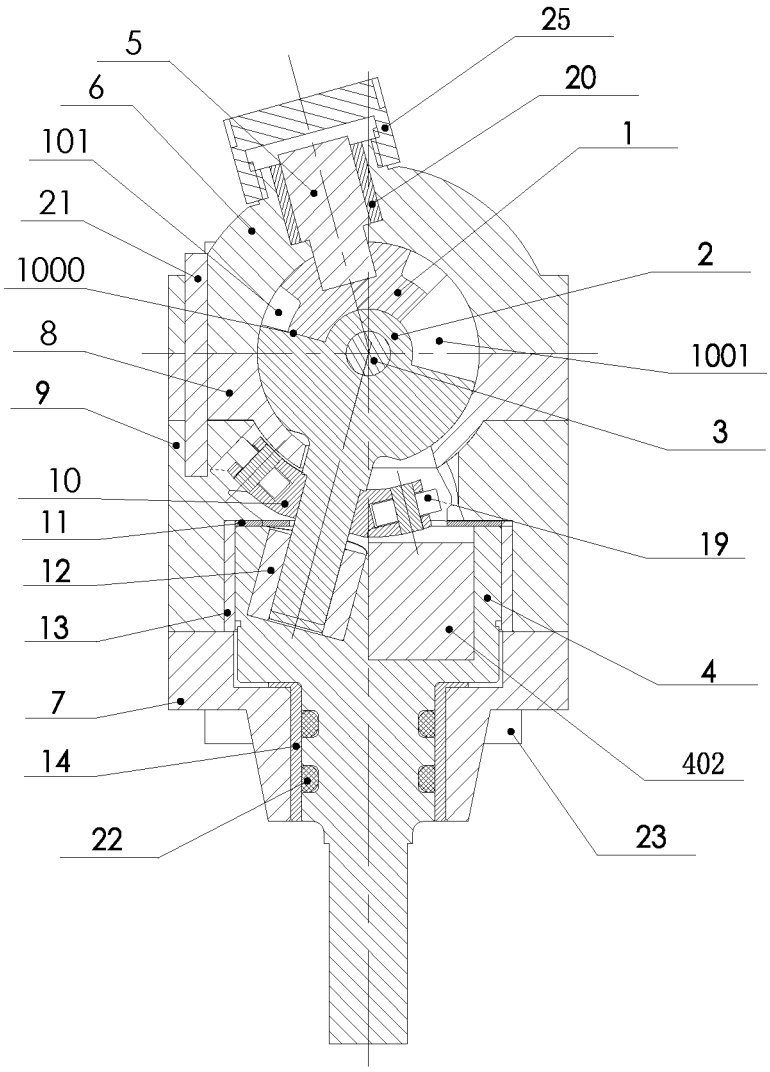
FIG. 17 is a sectional structural diagram of E-E section in a spherical compressor shown in FIG. 16.
Figure 18:
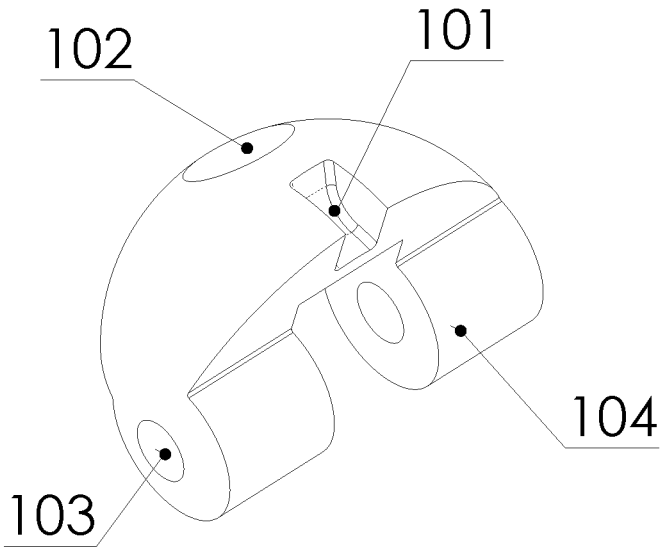
FIG. 18 is a stereoscopic structural diagram of a piston in a spherical compressor shown in FIG. 17.
Figure 20:
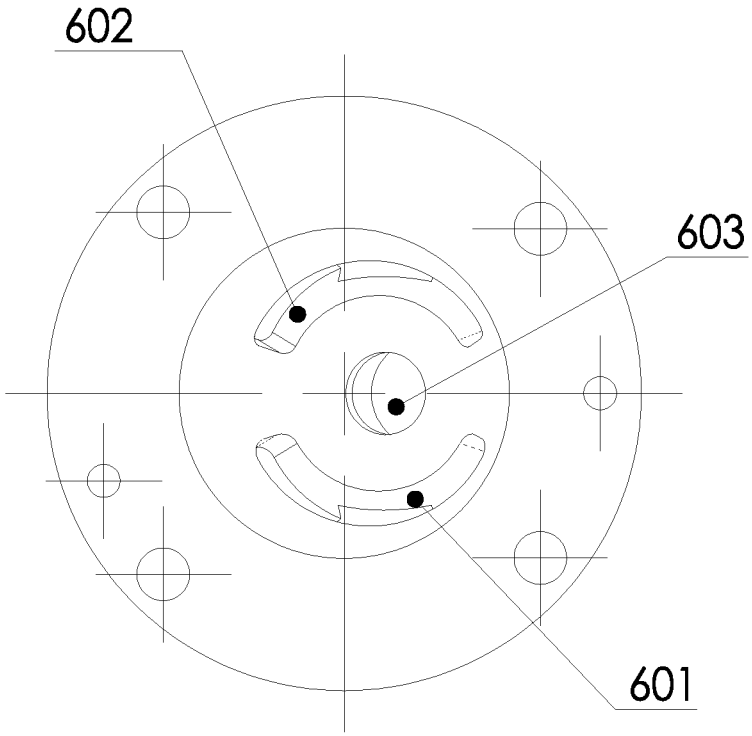
FIG. 20 is a bottom structural diagram of a cylinder head in a spherical compressor shown in FIG. 17.
Figure 21:
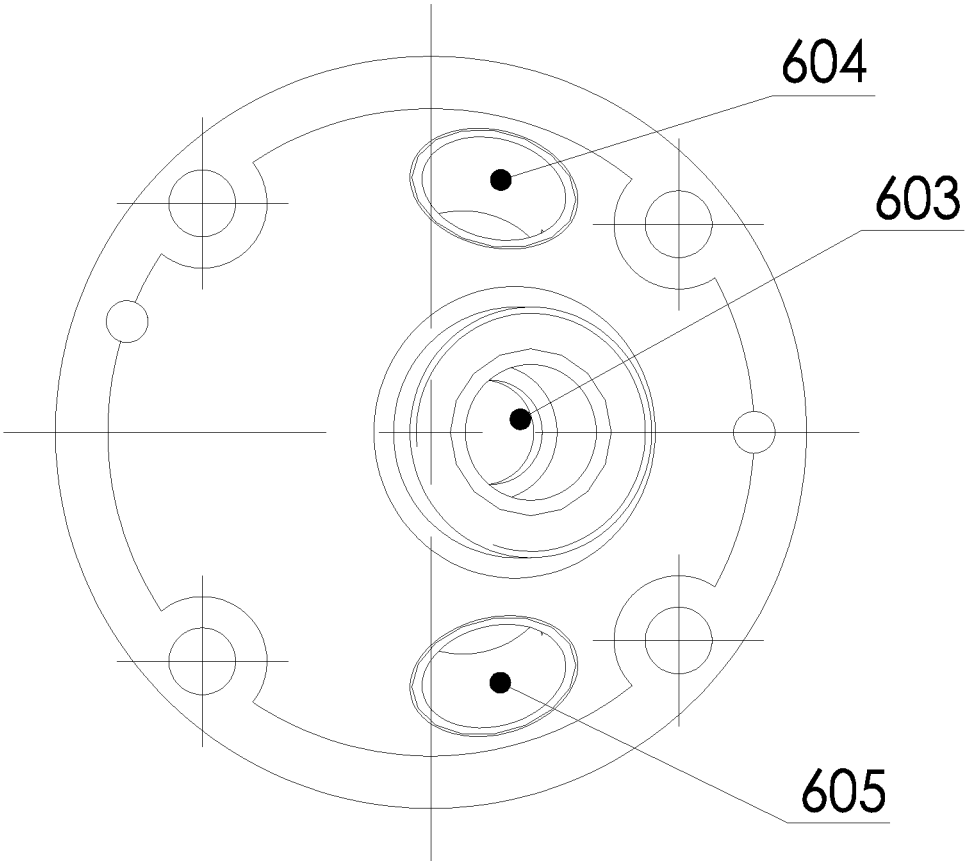
FIG. 21 is a top structural diagram of a cylinder head in a spherical compressor shown in FIG. 17.
Figure 22:
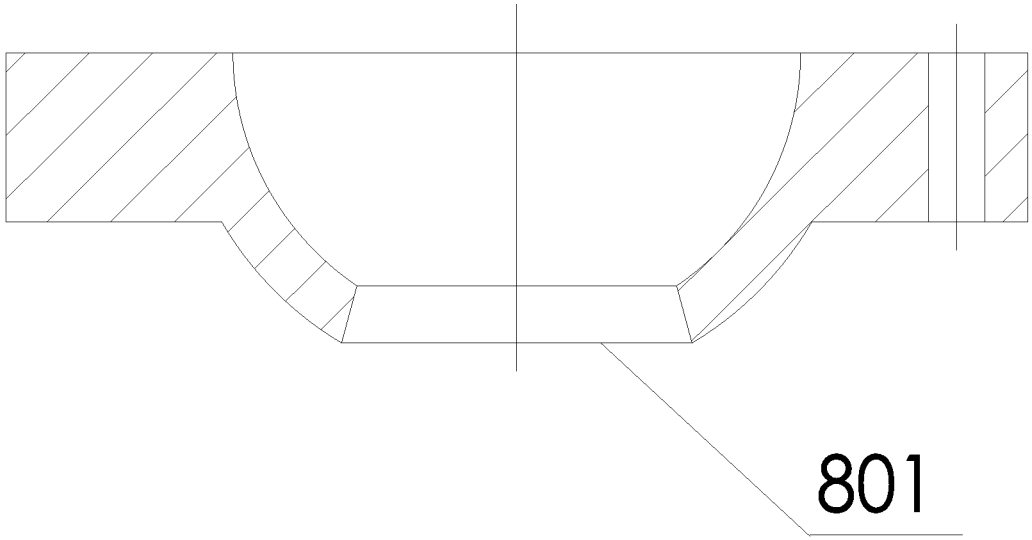
FIG. 22 is a sectional structural diagram of a cylinder in a spherical compressor shown in FIG. 17.

As shown in FIG. 1 and FIG. 2 or FIG. 16 and FIG. 17, the spherical compressor provided in some embodiments of the present invention comprises: a cylinder head 6, a piston 1, a cylinder 8, a turntable 2, an anti-locking device, a main shaft support 7 and a main shaft 4, wherein as shown in FIG. 5 and FIG. 6 or FIG. 20 and FIG. 21, the cylinder head 6 is a hollow semi-spherical shell; an intake hole 604 and an exhaust hole 605 are arranged in the cylinder head 6; an intake passage 601 communicated with the intake hole 604 and an exhaust passage 602 communicated with the exhaust hole 605 are arranged on the inner surface of the cylinder head 6; the piston 1 is installed in the cylinder head 6, and can rotate along its own axis; as shown in FIG. 3 or FIG. 18, the piston 1 has a spherical top surface concentric with the cylinder head 6; intake and exhaust ports 101 communicated with the intake hole 604 or the exhaust hole 605 are arranged in the piston 1; through the rotation of the piston 1 and the fit of the spherical surface of the piston 1 with the semi-spherical inner surface of the cylinder head 6, as basic movement elements of opening and closing the intake and exhaust ports 101, intake and exhaust control can be realized by opening and closing the intake and exhaust ports 101 as well as the intake passage 601 and the exhaust passage 602; as shown in FIG. 7 or FIG. 22, the cylinder 8 is a hollow semi-spherical shell; as shown in FIG. 2 and FIG. 17, the cylinder 8 is connected with the cylinder head 6 through a connecting screw 23 to form a hollow spherical shell; the turntable 2 is a hemispheroid concentric with the cylinder 8; the turntable 2 is embedded into the cylinder 8, and can rotate relative to the cylinder 8; the piston 1 is connected with the turntable 2 through a cylindrical hinge; a turntable axis 203 is arranged in the center of the outer spherical surface of the turntable 2; one end of the anti-locking device is connected with the cylinder 8 through the connecting screw 23, and the other end is connected with the main shaft support 7 through the connecting screw 23; the main shaft 4 is installed in the main shaft support 7, and can rotate along its own axis relative to the main shaft support 7; one end of the main shaft 4 is inserted into the anti-locking device, and an eccentric shaft hole 401 is arranged in the end surface of one end of the main shaft 4; the turntable shaft 203 penetrates through the cylinder 8 and the anti-locking device and is inserted into the eccentric shaft hole 401; the main shaft 4 rotates to drive the turntable shaft 203 to axially move; and when the main shaft 4 drives the turntable shaft 203 to move, the anti-locking device applies an acting force on the turntable shaft 203 so that the turntable shaft 203 always rotates along its own axis.

As shown in FIG. 10 and FIG. 11 or FIG. 25 and FIG. 26, to regulate the unbalanced force of the main shaft 4 during rotation, a balance block 402 can be installed on one side of the eccentric shaft hole 401 for ensuring the stability of the main shaft 4 during rotation.

Figure 4:
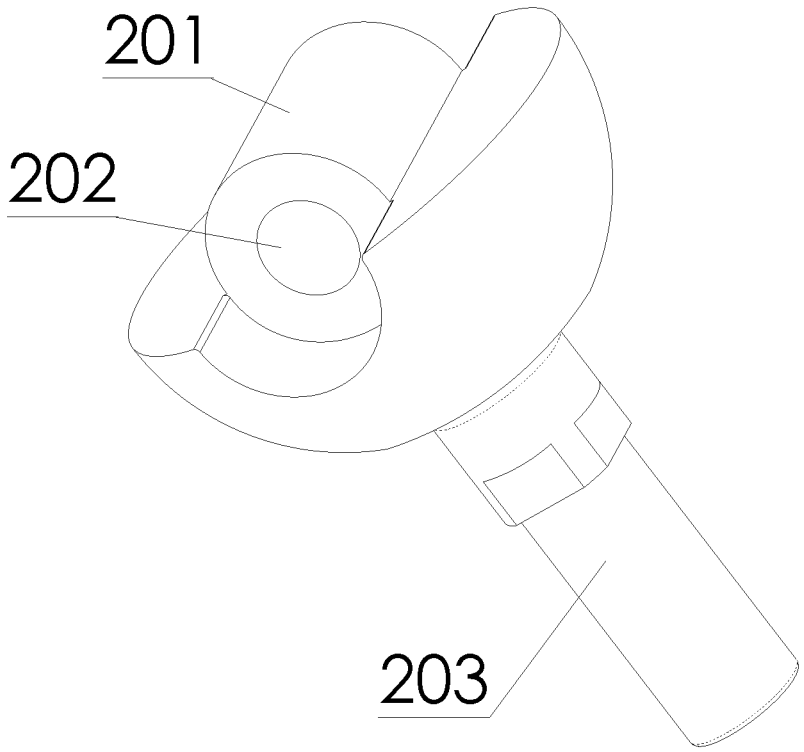
FIG. 4 is a stereoscopic structural diagram of a turntable in a spherical compressor shown in FIG. 2.
Figure 19:
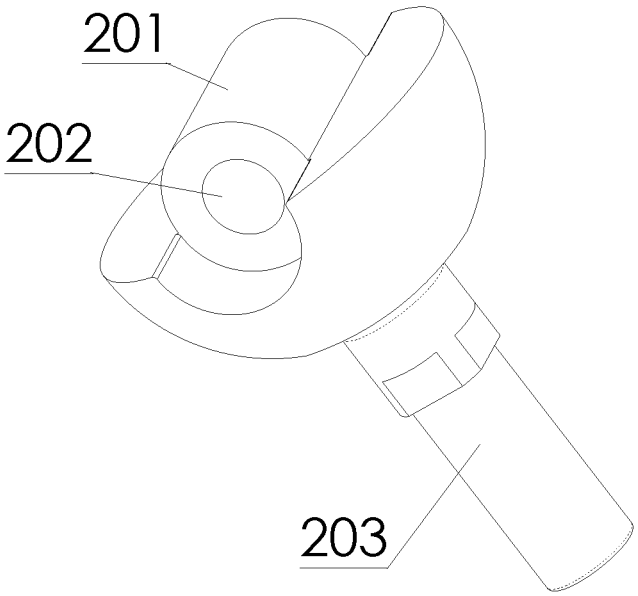
FIG. 19 is a stereoscopic structural diagram of connecting a turntable with a turntable shaft into a whole in a spherical compressor shown in FIG. 17.

As shown in FIG. 2 or FIG. 17, the turntable 2 is in cylindrical hinge connection with the piston 1 through a center pin 3. Specifically, as shown in FIG. 3 or FIG. 18, the center of the spherical top surface of the piston 1 is provided with one piston shaft hole 102, two angled side surfaces, intake and exhaust ports 101 and a piston pin boss 104 formed on the lower part of the two side surfaces of the piston 1; two intake and exhaust ports 101 are symmetrically distributed in the middle of half round edges of the two side surfaces of the piston 1; the piston pin boss 104 is a half-cylinder structure; grooves are arranged in the middle of the half-cylinder; perforated piston pin holes 103 are arranged in the axial direction of the half-cylinder; as shown in FIG. 4 or FIG. 19, a turntable pin boss 201 is arranged on the upper part of the turntable 2 relative to the piston pin boss 104; half-cylinder grooves are arranged on both ends of the turntable pin boss 201, and a protruded half-cylinder is arranged in the middle; a perforated turntable pin hole 202 is arranged in the axial direction of the half-cylinder; as shown in FIG. 2 or FIG. 17, the center pin 3 is inserted into the piston pin boss 104 and the turntable pin boss 201 to form the cylindrical hinge; the piston 1 and the turntable 2 form movable seal connection through the cylindrical hinge; and a semi-spherical cavity formed by the upper end surface and a spherical inner cavity of the turntable 2 is divided into a V1 workroom 1000 and a V2 workroom 1001.

The main shaft 4 drives the turntable 2 when rotating, and the turntable 2 drives the piston 1 to move (in the drawing, for the rotation direction of the main shaft 4, the main shaft 4 rotates clockwise seen from the cylinder head 6); the movement of the piston 1 is the unique rotation around the axis of the piston shaft 5; the movement of the turntable 2 synthesizes two movements: the first movement is rotation around its own axis; the other movement is that the axis always passes through the spherical center of the spherical inner cavity, and makes circumferential movement on a virtual conical surface having the spherical center of the spherical inner cavity as a vertex, having a conical angle of 2.alpha. and having an axis coincident with the axis of the main shaft 4 (i.e., the axis of the turntable 2 passes through the conical surface of the above cone); the movement cycle is synchronous with the rotation cycle of the main shaft 4; the above movements of a spatial mechanism are rotating movements, so no high-vibration movement part exists; the synthesis result of such spatial movements is: the piston 1 and the turntable 2 have a periodic relative swing; the swing cycle is one time the rotation cycle of the main shaft, and the swing amplitude is 4.alpha.; such relative swing is used as a basic movement element of volume change to form a V1 workroom 1000 and a V2 workroom 1001 with alternatively changed pressure; the intake passage 601 is connected with an inlet joint 15 outside the cylinder head through the intake hole 604 outside a communication cylinder; an internal thread is arranged on the intake hole 604 which is connected with the inlet joint 15 through the thread; the exhaust passage 602 is connected with an outlet joint 16 through the exhaust hole 605 outside the communication cylinder on the cylinder head 6; and an internal thread is arranged on the exhaust hole 605 which is connected with the outlet joint 16 through the thread.

Alternatively, as shown in FIG. 2, the piston shaft 5 is fixedly connected to the cylinder head 6; and the piston 1 is connected with the cylinder head 6 through the piston shaft 5. Specifically, an external thread is arranged in the middle of the piston shaft 5; one end is a hexagonal head structure, and the other end is a smooth shaft end matched with the piston shaft hole 102; a cylinder head end shaft hole 603 having the internal thread, matched with the external thread of the piston shaft 5, is arranged on the cylinder head 6; the shaft end of the piston shaft 5 is inserted into the piston shaft hole 102; the middle thread part of the piston shaft 5 is matched with the internal thread of the cylinder head end shaft hole 603 on the cylinder head 6; the piston shaft 5 is fixed to the cylinder head 6 through threaded connection; a flat gasket 29 is arranged on the connecting part of the piston shaft 5 with the cylinder head end shaft hole 603, and the flat gasket 29 performs the effects of pressing and sealing; the piston 1 can freely rotate around the piston shaft 5; and the spherical top surface of the piston and the semi-spherical inner cavity have the same spherical center and form movable seal fit.

Alternatively, as shown in FIG. 17, a threaded seal head 25 is fixedly connected to the cylinder head; the piston is connected with the cylinder head through the threaded seal head 25; as shown in FIG. 20 and FIG. 21, a cylinder head end shaft hole 603 is arranged in the cylinder head 6; a hole seat of the cylinder head end shaft hole 603 is protruded from the cylinder head 6; the shaft diameter size of the shaft end of the piston shaft 5 is matched with the piston shaft hole 102; referring to FIG. 17, the shaft end of the piston shaft 5 is inserted into the piston shaft hole 102; the other end of the piston shaft 5 is matched with the inner hole of the cylinder head end shaft hole 603 to form rotating fit; the internal thread of the thread seal head 25 is matched with the external thread on an outer circle, wherein the external thread is arranged on the cylinder head end shaft hole 603 and is protruded from the cylinder head 6; the piston shaft 5 is axially limited through the threaded seal head 25 and performs the effect of sealing; the piston 1 can freely rotate around the axis of the piston shaft 5 in the spherical inner cavity; and the spherical top surface of the piston and the semi-spherical inner cavity have the same spherical center and form movable seal fit.

As shown in FIG. 2 or FIG. 17, the anti-locking device comprises: a cylinder block 9 and a rotating component, wherein one end of the cylinder block 9 is fixedly connected with the cylinder 8 and forms an accommodating space at the joint; a slideway is arranged in the accommodating space; the other end of the cylinder block 9 is fixedly connected with the main shaft support 7; the rotating component is located in the accommodating space; the rotating component is fixedly connected with the turntable shaft 203; and the turntable shaft 203 can drive the rotating component to move in a manner of fitting to the wall surface of the slideway.

Figure 13:
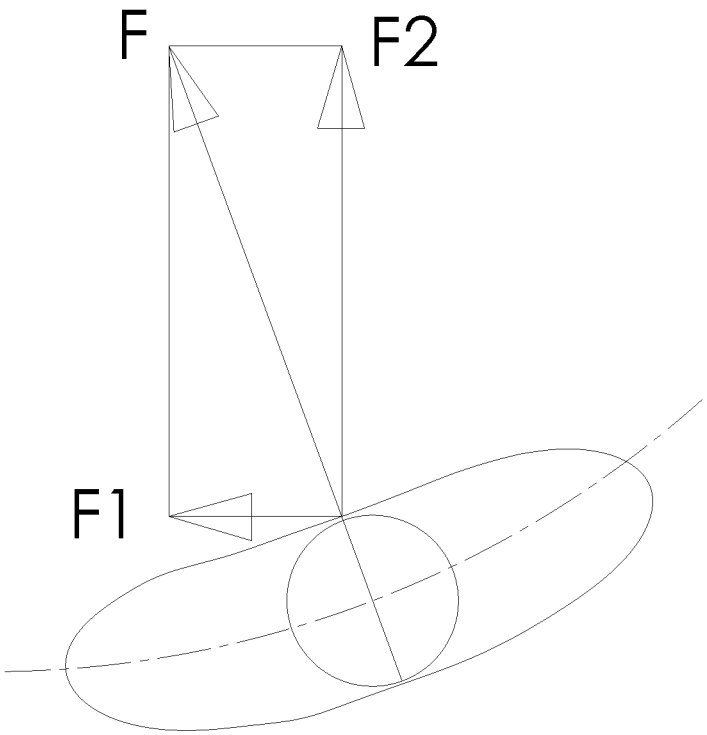
FIG. 13 is a force diagram of a turntable when guide sleeves are in a concave slideway.
Figure 33:
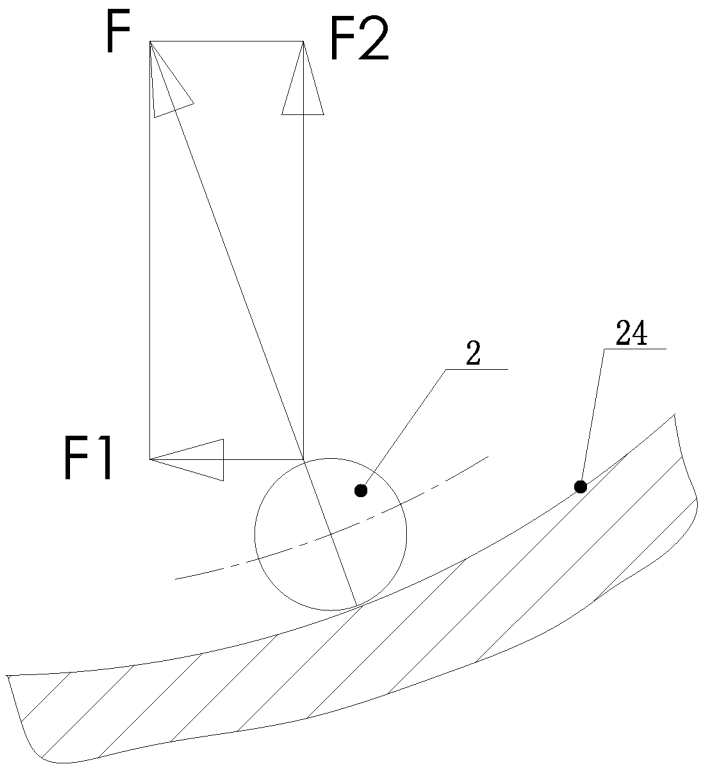
FIG. 33 is a force diagram of a turntable when a power handle contacts a track limiting surface.

The working principle is: in the rotation process of the main shaft 4, before the turntable axis and the piston axis are superposed, because the end part of the rotating component contacts the wall surface of the slideway and slides along its own movement track on the wall surface of the slideway with the rotation of the turntable 2, the turntable 2 and the piston 1 have a relative swing trend under the effect of the main shaft 4; such trend generates an extrusion force F between the rotating component and the wall surface of the slideway; the stress state is shown in FIG. 13 or FIG. 33; the force F generates a component force F1 in the rotation direction of the turntable 2; under the effect of the force F1, the turntable 2 obtains a torque of rotating around the axis of the turntable to continue to rotate; even if the piston axis and the turntable axis are superposed, the component force still remains and becomes autorotation power when the turntable rotates at a dead point; that is, at the position of the dead point, the turntable 2 is pushed by the component force to continue to rotate.

Alternatively, as shown in FIG. 2, FIG. 8, FIG. 9, FIG. 12 and FIG. 15, the rotating component comprises: a pin boss 26, guide pins 27 and guide sleeves 28; the pin boss 26 is fixedly connected with the turntable shaft 203; one end of the guide pins 27 is fixedly connected with the end part of the pin boss 26, and the other end of the guide pins 27 is inserted into the slideway; the guide sleeves 28 are sleeved on the guide pins 27, and are located in the slideway; the slideway is a concave slideway 902 arranged on the cylinder block 9 or the cylinder 8; and the cross-sectional shape of the concave slideway 902 is fitted with the shape of the guide sleeves 28. Specifically, pin holes are symmetrically arranged in both ends of the arc of the pin boss 26 by using the turntable shaft 203 as a symmetrical shaft; two guide pins 27 are respectively inserted into the pin holes and fixed; two guide pins 27 are respectively symmetrically arranged on both sides of the pin boss 26; part of each guide pin 27 which extends from the pin boss 26 is movably connected with the guide sleeves 28; a square hole is arranged in the center of the arc of the pin boss 26 which is fixed to square steps in the middle of the turntable shaft 203 through the square hole; the guide sleeves 28 sink to the concave slideway 902, and the guide sleeves 28 slide in the concave slideway 902 with the rotation of the turntable 2; meanwhile, the guide sleeves 28 can rotate on the guide pins 27; the pin boss 26 rotates in a spherical rotating body space along with the turntable shaft 203; movable clearances are reserved between the upper part of the pin boss 26 and the cylinder lower spherical surface 802 and between the lower part of the pin boss 26 and the cylinder block spherical surface 903; and the sizes of the clearances shall not interfere with the cylinder lower spherical surface 802 and the cylinder block spherical surface 903 in the rotation process of the pin boss 26.

Figure 12:
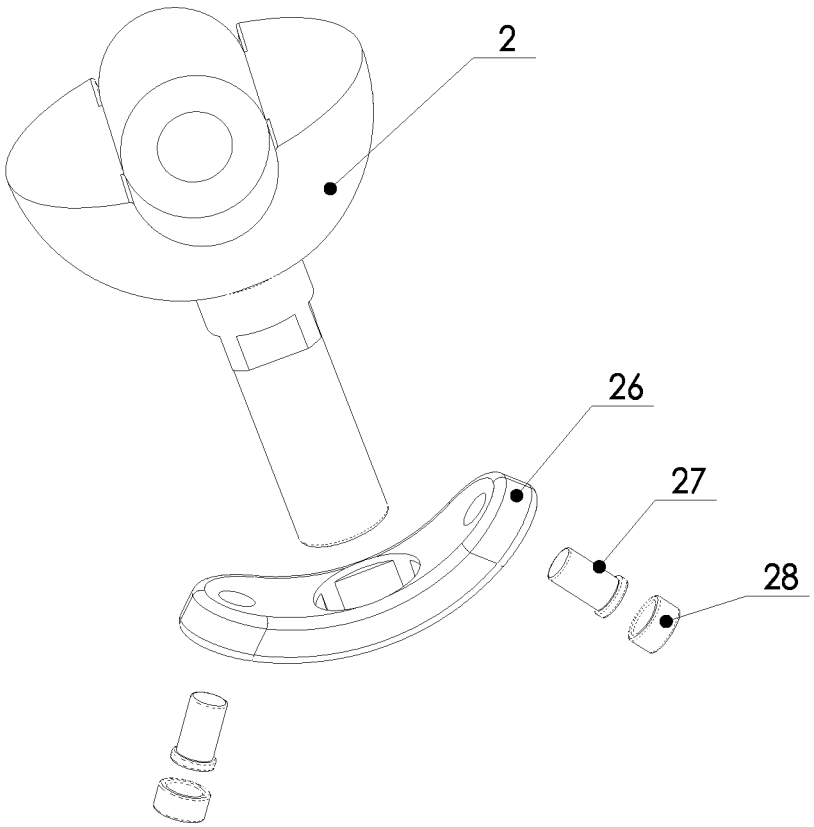
FIG. 12 is an exploded diagram of an assembly structure of a turntable, a pin boss, guide pins and guide sleeves in a spherical compressor shown in FIG. 2.
Figure 15:
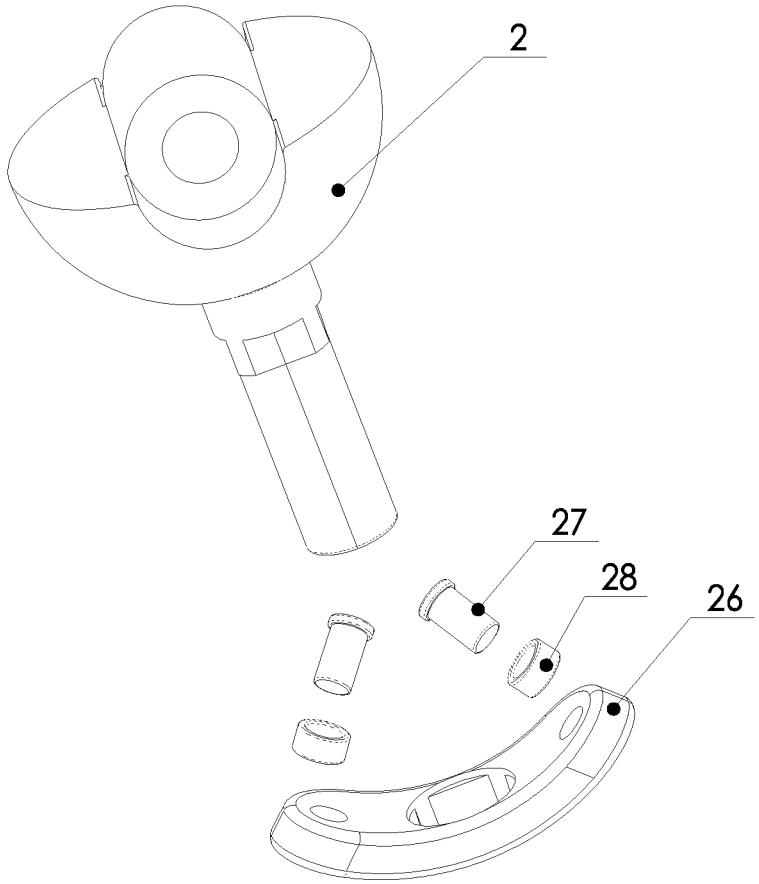
FIG. 15 is an exploded diagram of an assembly structure of a turntable, a pin boss, guide pins and guide sleeves when guide sleeves in a spherical compressor shown in FIG. 2 are located on one side of a cylinder on a pin boss.

Of course, in the embodiment, as shown in FIG. 12, the guide sleeves 28 can be arranged on the pin boss 26 on one side of the cylinder block 9. At this moment, the concave slideway 902 is on the cylinder block spherical surface 903; or as shown in FIG. 15, the guide sleeves 28 are arranged on the pin boss 26 on one side of the cylinder 8. At this moment, the concave slideway 902 is arranged on the cylinder lower spherical surface 802.

Figure 27:
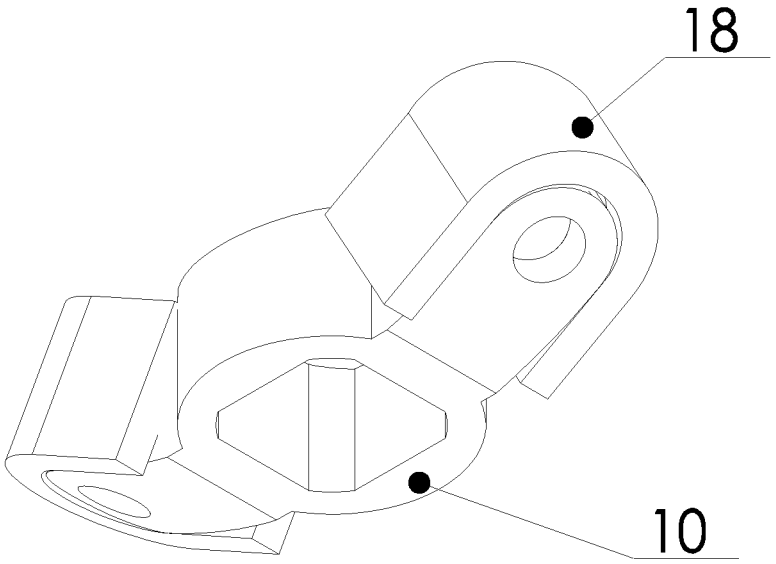
FIG. 27 is a structural diagram of a power handle having piston shoes on both ends in a spherical compressor shown in FIG. 17.

Alternatively, as shown in FIG. 27, the rotating component comprises: a power handle 10 and slip shoes 18, wherein the power handle 10 is fixedly connected with the turntable shaft 203, and by adopting the axis of the turntable shaft 203 as a symmetric axis, the power handle 10 arranged at two sides of the turntable shaft 203 is of a symmetric structure; the slip shoes 18 are arc slip shoes which are made of elastic wear-resistant materials, two slip shoes 18 are provided, the two slip shoes 18 are respectively and fixedly connected to two ends of the power handle 10, and when the turntable shaft 203 drives the power handle 10 to move, the slip shoes 18 move in a manner of fitting to the wall surface of the slideway; specifically, a square installation hole is arranged in the middle of the power handle 10, a square step matched with the installation hole is provided in the middle of the turntable shaft 203, the power handle 10 is fixed on the square step of the turntable shaft 203 through the installation hole, and when the power handle 10 rotates, the slip shoes 18 move in a manner of fitting to the wall surface of the slideway; the slip shoes 18 are made of PEEK, copper or other elastic wear-resistant materials and are fixed at two ends of the power handle 10 in a riveting manner or a bolt connection manner; and the slip shoes 18 are symmetric about the axis of the turntable shaft 203.

Figure 28:
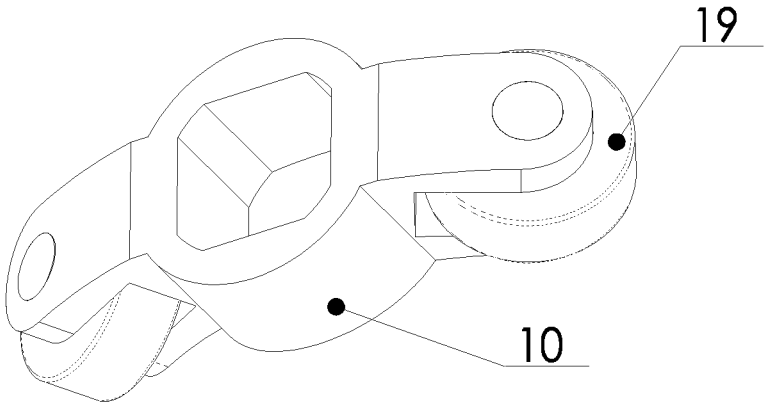
FIG. 28 is a structural diagram of a power handle having pulleys on both ends in a spherical compressor shown in FIG. 17.

Alternatively, as shown in FIG. 28, the rotating component comprises: a power handle 10 and pulleys 19, wherein the power handle 10 is fixedly connected with the turntable shaft 203, and by adopting the axis of the turntable shaft 203 as a symmetric axis, the power handle 10 arranged at two sides of the turntable shaft 203 is of a symmetric structure; two pulleys 19 are provided, the two pulleys 19 are rotatably connected to two ends of the power handle 10, and when the turntable shaft 203 drives the power handle 10 to move, the pulleys 19 move in a manner of fitting to the wall surface of the slideway; and specifically, a square installation hole is arranged in the middle of the power handle 10, a square step matched with the installation hole is provided in the middle of the turntable shaft 203, the power handle 10 is fixed on the square step of the turntable shaft 203 through the installation hole, the pulleys 19 rotate in a manner of fitting to the wall surface of the slideway, and the two pulleys 19 are symmetric about the axis of the turntable shaft 203.

Figure 29:
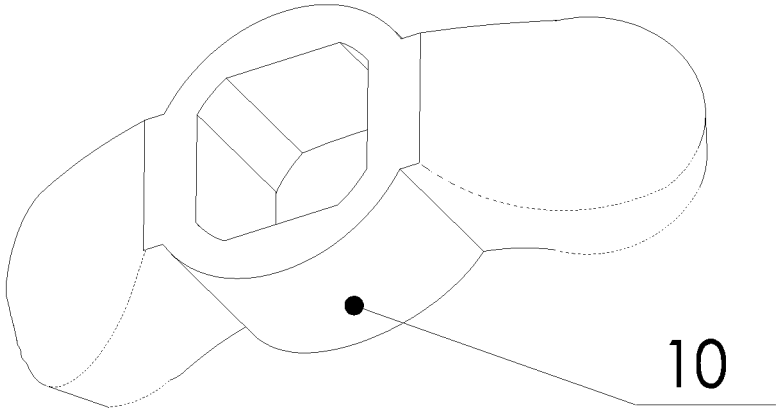
FIG. 29 is a structural diagram of a power handle having smooth arcs on both ends in a spherical compressor shown in FIG. 17.
Figure 34:
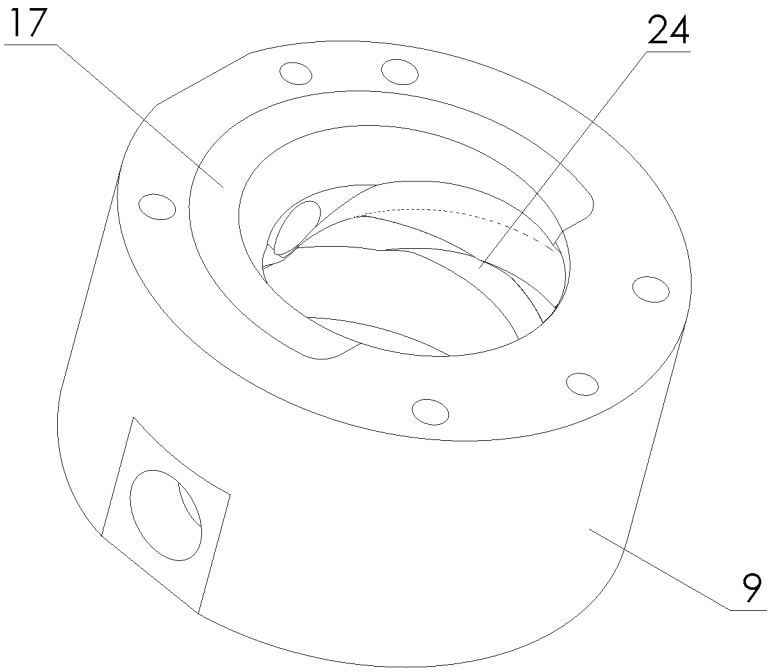
FIG. 34 is a structural diagram of a cylinder block having an insert.

Alternatively, as shown in FIG. 29, the rotating component comprises: a power handle 10 and an insert 17, wherein two ends of the power handle 10 are of an arc structure, the power handle 10 is fixedly connected with the turntable shaft 203, and by adopting the axis of the turntable shaft 203 as the symmetric axis, the power handle 10 arranged at two sides of the turntable shaft 203 is of a symmetric structure; the insert 17 is made of an elastic wear-resistant material, the insert 17 is embedded into the wall surface of the slideway, and when the turntable shaft 203 drives the power handle 10 to move, the end part of the power handle 10 moves in a manner of fitting to the insert; specifically, a square installation hole is provided in the middle of the power handle 10, a square step matched with the installation hole is provided in the middle of the turntable shaft 203, the power handle 10 is fixed on the square step of the turntable shaft 203 through the square installation hole, two ends of the power handle 10 are of the arc structure, arcs at two sides are symmetric about the axis of the turntable shaft 203, the arcs have no slip shoe 18 or pulley 19 fixedly connected, and during the rotation process of the power handle 10, the arcs at two sides slide in a manner of contacting the wall surface of the slideway; in order to improve the wear resistance and the matched flexibility, as shown in FIG. 34, the insert 17 which is made of PEEK, copper or other elastic wear-resistant materials is provided on the wall surface of the slide way contacted with two ends of the power handle 10; the insert 17 is arranged in an autorotation travel range in which the power handle 10 is contacted with the wall surface of the slideway when the power handle 10 rotates to a position nearby the dead point of the mechanism; and in FIG. 34, the slideway is arranged on the cylinder block 9, the insert 17 is made of PEEK and fixed on the cylinder block 9 in a mechanical embedding manner, and the surface of the insert 17 forms one part of the wall surface of the slideway.

Alternatively, the rotating component comprises: a power handle 10 and a magnetic insert, wherein the power handle 10 is fixedly connected with the turntable shaft 203, and by adopting the axis of the turntable shaft 203 as a symmetric axis, the power handle 10 arranged at two sides of the turntable shaft 203 is of a symmetric structure; the magnetic insert is embedded into the wall surface of the slideway, and magnetic poles of opposite magnetic layers of the power handle 10 are identical to that of the magnetic insert; specifically, a certain clearance is formed between the magnetic layers at two ends of the assembled power handle 10 and the magnetic insert of the wall surface of the slideway; the magnetic insert is fixed on the wall surface of the slideway in a mechanical embedding way, and the magnetic insert is arranged in the travel range when the power handle 10 rotates to the position nearby the dead point of the mechanism and when two ends of the power handle 10 approach the wall surface of the slideway; and therefore, when the turntable 2 rotates to the position nearby the dead point, the magnetic material on the power handle 10 is close to the magnetic insert on the wall surface of the slideway, due to the identical polarity of the magnetic poles, a repellent magnetic force is generated, the magnetic force is used as the rotation power to drive the power handle 10 to rotate continuously, and the magnetic insert and the magnetic materials at two ends of the power handle 10 may be permanent magnets or electromagnetic materials.

Figure 30:
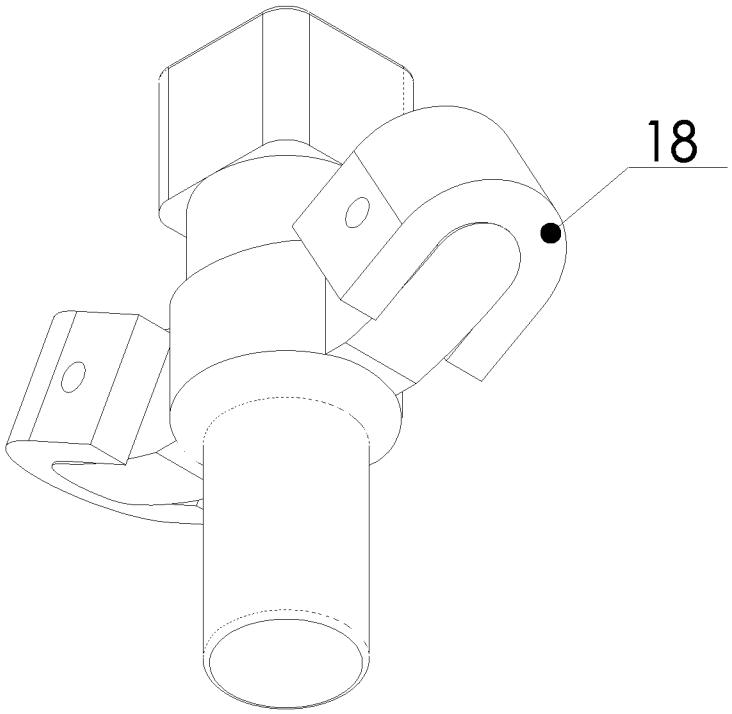
FIG. 30 is a structural diagram of an integral power stem of connecting a power handle shown in FIG. 27 with a turntable shaft into a whole.
Figure 32:
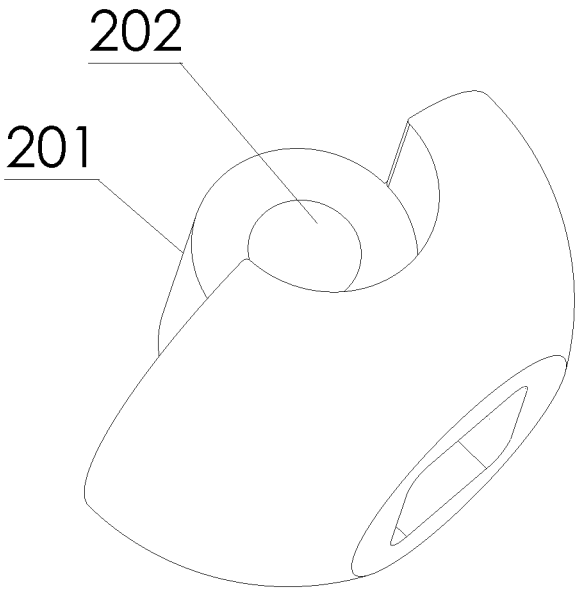
FIG. 32 is a stereoscopic structural diagram of a turntable having an independent turntable shaft in a spherical compressor shown in FIG. 17.

It shall be noted that the installation hole in the middle of the power handle 10 is a square hole; the power handle 10 is fixedly installed on a square step of the turntable shaft 203 through the square hole; the square step of the turntable shaft 203 is arranged between the cylinder 8 and the cylinder block 9; in real application, a circular hole with a key slot or a spline groove may be arranged in the middle of the power handle 10; and the corresponding portion of the turntable shaft 203 is a circular shaft with a key slot or a spline; the wall surface of the slide way may be the whole wall surface or partial wall surface at which two ends of the power handle 10 are separately contacted with the cylinder block 9 in the rotation process of the turntable 2; if the wall surface of the slideway is the partial wall surface, the wall surface shall satisfy that when the turntable 2 rotates to a position at which the turntable axis and the piston axis are superposed, i.e. the position nearby the dead point of the mechanism, the partial wall surface can be contacted with two ends of the power handle 10; the turntable shaft 203 can be made into an independent structure independent from the turntable 2; as shown in FIG. 30 and FIG. 32, the installation square hole of the turntable shaft 203 is arranged in the portion connected with the turntable shaft 203 on the turntable 2; the shape of one end of the turntable shaft 203 connected with the turntable 2 is a square structure matched therewith; the square end of the turntable shaft 203 is inserted into the installation square hole of the turntable shaft and then is circumferentially fixed; the power handle 10 is arranged in the middle of the turntable shaft 203 and manufactured into an integral component with the turntable shaft 203; and the other end of the turntable shaft 203 is a circular shaft end and is inserted into an eccentric shaft hole 401 of the main shaft.

Additionally, due to the high pressure volume formed in the relative movement process of the piston 1 and the turntable 2, the turntable spherical surface generates local pressure on the cylinder spherical surface; the higher the output pressure of the compressor is, the larger the imbalance pressure generated by the turntable 1 on the cylinder 8 is; such imbalance local pressure causes the increasing friction force between the turntable 1 and the cylinder 8, thereby causing the abnormal abrasion of the turntable 1 and the cylinder 8, and easily resulting in the movement locking of the rotor; and in order to solve the above problem, in present embodiment, a backpressure support is arranged on the turntable 2 to balance the local pressure generated by the turntable spherical surface on the cylinder spherical surface due to the formation of a high pressure working chamber, so that the friction force between the turntable 2 and the cylinder 8 is reduced, and the rotor is prevented from being locked in the rotation process.

Alternatively, a backpressure groove is arranged in the portion on which the cylinder 8 is always fitted to the turntable 2; the spherical compressor further comprises: a backpressure air passage, wherein one end of the backpressure air passage is communicated with an exhaust passage 602, the other end of the backpressure air passage is communicated with the backpressure groove, and a high pressure medium in the exhaust passage 602 enters the backpressure groove through the backpressure air passage to form the backpressure support to the turntable; specifically, the cylinder head 6 and the cylinder 8 are provided with the backpressure air passages communicated with each other; the backpressure air passage on the cylinder head 6 is communicated with the exhaust passage 602 on the cylinder head 6; the backpressure air passage on the cylinder 8 is communicated with the backpressure groove; high pressure gas or liquid in the exhaust passage 602 enters the backpressure groove through the backpressure air passage to form the backpressure support on the turntable spherical surface, wherein the backpressure groove may be a local groove or a continuous annular groove on the rotation cycle of the turntable 2; and when the turntable 2 rotates to any position, the backpressure groove shall be arranged on the portion on which the turntable spherical surface is contacted (matched) with the cylinder spherical surface.

The spherical compressor further comprises intake lead-in passages and intake return passages, wherein an inlet of each intake lead-in passage is arranged on the outer side wall of the cylinder 8, and an outlet of each intake lead-in passage is communicated with an accommodating space; an outlet of each intake return passage is communicated with an intake hole 604, and an inlet of each intake return passage is communicated with the accommodating space; specifically, the cylinder 8 and the cylinder block 9 are provided with the intake lead-in passages communicated with each other; the inlet of each intake lead-in passage is arranged on the outer side wall of the cylinder 8, and the outlet of each intake lead-in passage is communicated with the accommodating space where the power handle 10 is arranged; the cylinder block 9, the cylinder 8 and the cylinder head 6 are provided with the intake return passages successively communicated with one another; the outlet of each intake return passage is connected with the intake hole 604 of the compressor, and the inlet of each intake return passage is communicated with the accommodating space; the intake lead-in passage and the intake return passage on the cylinder block 9 are communicated to a bearing portion where the main shaft is matched with the cylinder block bushing 13 and the bearing portion where the main shaft support 7 is matched with the main shaft to form a lubrication and cooling passage for the compressor; the low-pressure low-temperature gas or liquid before the compression enters the bearing portion where the cylinder block bushing 13 is matched with the main shaft 4 through the intake lead-in passages and can also enter the bearing portion where the main shaft support 7 is matched with the main shaft 4 so as to lubricate and cool the bearing portion; the low-pressure gas or liquid enters a rotating body space of the power handle 10 through the intake lead-in passages to cool and lubricate the mechanism; and such low-pressure low-temperature gas or liquid is returned to the intake hole 604 of the compressor through the intake return passages and is used as the working medium to realize further compression. It shall be noted that because the gas at the intake end is from the compression medium when the compressor is used for the refrigeration circulation, and when the low-pressure gas is used as the compression medium, lubricating oil is generally contained and used for lubricating the matched portion where the compression medium flows by, the lubrication can be realized by means of the flow of the compression medium. This is the prior art and is not stated in detail, and the same content and principle are not repeated below.

Alternatively, the spherical compressor further comprises: backpressure air passages and gas return passages, wherein an intake port of each backpressure air passage is communicated with the exhaust passage; an exhaust port of each backpressure air passage is arranged on the end surface of the cylinder block forming the accommodating space; the high pressure medium in the exhaust passage enters the accommodating space through the backpressure air passage to form the backpressure support to the turntable; the inlet of each gas return passage is arranged on the end surface of the cylinder block forming the accommodating space, and the outlet of each gas return passage is communicated with the exhaust hole; specifically, the cylinder head 6, the cylinder 8 and the cylinder block 9 are provided with the backpressure air passages communicated with one another; the backpressure air passage on the cylinder head 6 is connected with the exhaust passage 602; the outlet of each backpressure air passage on the cylinder block 9 is formed in the inner surface of the cylinder block 9 forming the accommodating space in which the power handle 10 rotates around the turntable shaft 203; the high pressure gas or liquid discharged from the exhaust passage 602 enters the accommodating space of the power handle 10 successively through the backpressure air passages of the cylinder head 6, the cylinder 8 and the cylinder block 9 to form the integral backpressure support on the lower part of the turntable 2; the cylinder block 9, the cylinder 8 and the cylinder head 6 are also provided with the gas return passages communicated with one another; the inlet of each gas return passage is formed in the inner surface of the cylinder block 9 forming the accommodating space of the power handle 10, and the outlet of each gas return passage can be formed in the cylinder head 6 and is communicated with the exhaust hole 605.

In the backpressure support way, the following cooling and lubrication way is adopted; and the backpressure air passage and the gas return passage on the cylinder block 9 are communicated onto the bearing portion where the main shaft 4 is matched with the cylinder block bushing 13 and the bearing portion where the main shaft support 7 is matched with the main shaft 4 to form a lubrication and cooling passage for the compressor. The cooling and the lubrication are realized by means of the compressed gas or liquid. It shall be noted that although the compressed gas or liquid is at a high temperature, the temperature of the compressed gas or liquid is relatively low relative to the mechanism components, so that the components can be cooled; in addition, when the gas is used as the compression medium, the lubricating oil is generally contained and used for lubricating the matched portion through which the compression medium flows; when the liquid is used as the compression medium, the liquid generally has the lubricating effect, or a lubricating material is added into the liquid, so that the lubrication can be realized by means of the flow of the compression medium. This is the prior art and is not stated in detail herein; and the same content and principle are not repeated hereinafter.

As shown in FIG. 1 and FIG. 2, the spherical compressor provided in some other embodiments of the present invention comprises a piston 1, a turntable 2, a center pin 3, a main shaft 4, a cylinder head 6, a cylinder 8, a cylinder block 9 and a main shaft support 7, wherein the cylinder head 6, the cylinder 8, the cylinder block 9 and the main shaft support 7 are successively connected through connecting screws 23 to form a casing of the spherical compressor; as shown in FIG. 5, FIG. 6 and FIG. 7, the cylinder head 6 and the cylinder 8 are provided with semi-spherical inner surfaces which are connected through the connecting screws 23 to form a spherical inner cavity of the spherical compressor, the cylinder block 9 is connected to the lower part of the cylinder 8 through the connecting screws 23; a convex spherical bottom surface, i.e. the cylinder lower spherical surface 802 is provided on the lower part of the cylinder 8; the spherical diameter of the cylinder lower spherical surface 802 is greater than that of the semi-spherical inner surface of the cylinder 8, and the cylinder lower spherical surface 902 has the same spherical center with the semi-spherical inner surface of the cylinder 8; the cylinder shaft hole 801 penetrates through the center of the cylinder lower spherical surface 802; the surface of the cylinder block 9 corresponding to the cylinder lower spherical surface 802 is a spherical surface, i.e. the cylinder block spherical surface 903; the spherical center of the cylinder block spherical surface 903 is identical to that of the cylinder lower spherical surface 802; the spherical diameter of the cylinder block spherical surface 903 is greater than that of the cylinder lower spherical surface 802; a spherical rotating body space adopting the turntable shaft 203 as a rotating axis is formed between the cylinder block 9 and the cylinder 8; the cylinder block shaft hole 901 penetrates through the center of the cylinder block spherical surface 903; and in order to guarantee the matching and positioning accuracy of all spherical surfaces, positioning pins 21 are arranged on the connection portions of the cylinder head 6, the cylinder 8 and the cylinder block 9.

As shown in FIG. 3, the piston 1 has a spherical top surface, and the center of the spherical top surface is provided with one piston shaft hole 102, two angled side surfaces, intake and exhaust ports 101 and a piston pin boss 104 formed on the lower part of the two side surfaces of the piston 1; two intake and exhaust ports 101 are symmetrically distributed in the middle of half round edges of the two side surfaces of the piston 1; the piston pin boss 104 is a half-cylinder structure; grooves are arranged in the middle of the half-cylinder; perforated piston pin holes 103 are arranged in the axial direction of the half-cylinder; the piston shaft 5 is a screw plug structure; one end of the piston shaft 5 is a smooth shaft end; the shaft diameter size of the shaft end is matched with the piston shaft hole 102; the middle of the piston shaft 5 is a thread; the other end is a hexagonal head structure; as shown in FIG. 5 and FIG. 6, an internal thread shaft hole matched with the piston shaft 5 is arranged on the cylinder head 6; the shaft end of the piston shaft 5 is inserted into the piston shaft hole 102; the middle thread part of the piston shaft 5 is matched with the internal thread of the cylinder head end shaft hole 603 on the cylinder head 6; the piston shaft 5 is fixed to the cylinder head 6 through threaded connection; a flat gasket 29 is arranged on the connecting part of the piston shaft 5 with the cylinder head end shaft hole 603, and performs the effects of pressing and sealing; the piston 1 can freely rotate around the piston shaft 5; and the spherical top surface of the piston and the semi-spherical inner cavity have the same spherical center and form movable seal fit.

As shown in FIG. 4, a turntable shaft 203 extends from the center of the lower end surface of the turntable 2; a turntable spherical surface exists on a peripheral surface between the upper part and the lower end surface of the turntable 2; the spherical inner cavity formed by the cylinder 8 and the cylinder head 6 has the same spherical center with the turntable spherical surface; the turntable spherical surface is close to the spherical inner cavity to form movable seal fit; a turntable pin boss 201 is arranged on the upper part of the turntable 2 relative to the piston pin boss 104; half-cylinder grooves are arranged on both ends of the turntable pin boss 201, and a protruded half-cylinder is arranged in the middle; and a perforated turntable pin hole 202 is arranged in the axial direction of the half-cylinder.

Figure 10:
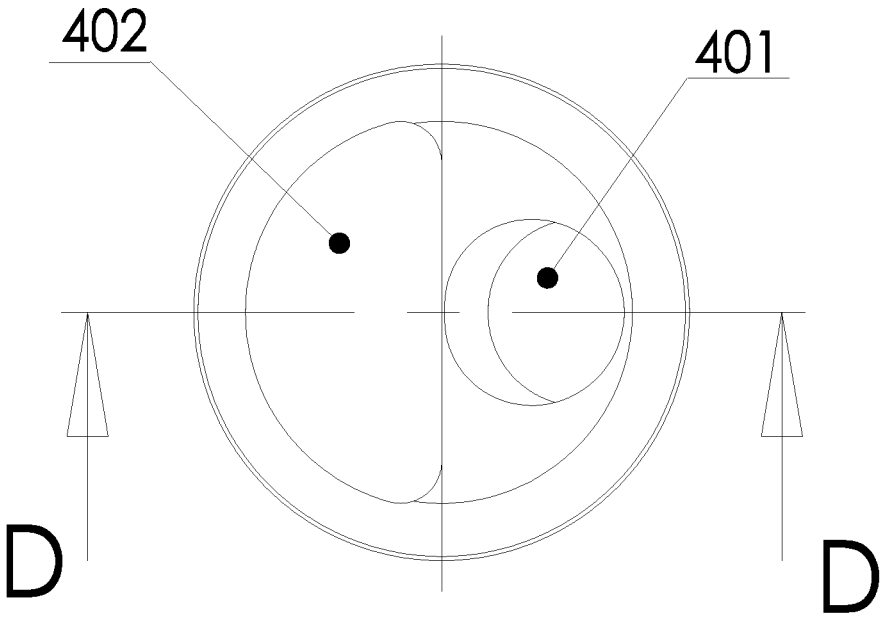
FIG. 10 is a top structural diagram of a main shaft in a spherical compressor shown in FIG. 2.
Figure 11:
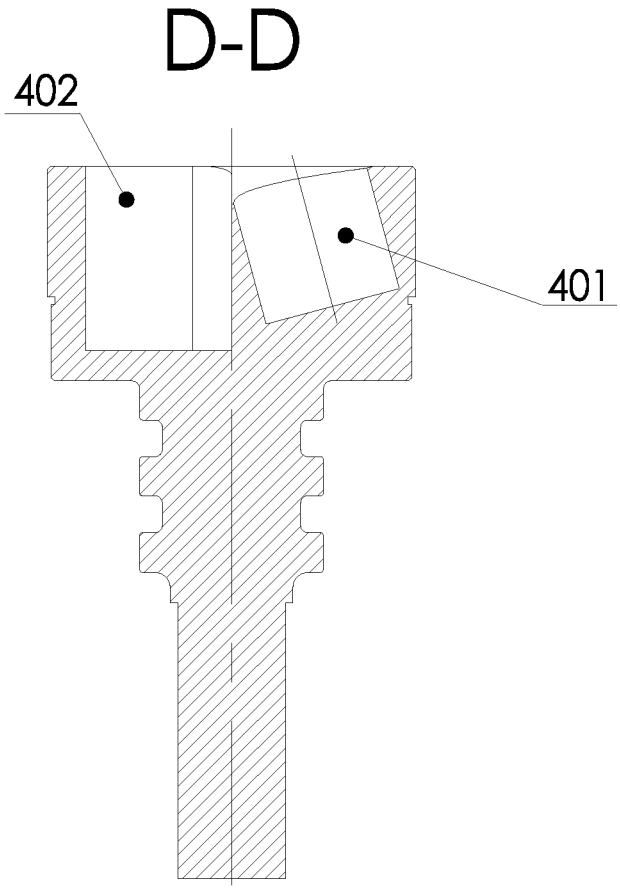
FIG. 11 is a sectional structural diagram of D-D section in a main shaft shown in FIG. 10.

As shown in FIG. 2, the center pin 3 is inserted into the piston pin boss 104 and the turntable pin boss 201; the main shaft support 7 is connected with the cylinder block 9 through a connecting screw 23 to provide support for the rotation of the main shaft 4; as shown in FIG. 2, FIG. 10 and FIG. 11, an eccentric shaft hole 401 and a balance block 402 are arranged on one end of the main shaft 4; the end part of the main shaft 4 is located in the cylindrical cavity under the cylinder block 9 and connected with the turntable shaft 203; the other end is connected with a power mechanism to provide power for capacity change of a compressor; the balance block 402 is used for regulating the unbalanced force of the main shaft 4 during rotation; a regulating pad 11 is arranged on the contact part between the upper end surface of the main shaft 4 and the lower bottom surface of the cylinder block 9, for regulating the height of the main shaft 4 during assembly; the axes of the above piston shaft 5, the turntable shaft 203 and the main shaft 4 pass through the spherical center of the spherical inner cavity formed by the cylinder 8 and the cylinder head 6; the axis of the piston shaft 5 and the axis of the turntable shaft 203 form the same inclined angle .alpha. with the axis of the main shaft 4; the center pin 3 is inserted into the piston pin hole 103 of the piston 1 and the turntable pin hole 202 of the turntable 2 to form the cylindrical hinge; the piston 1 and the turntable 2 form movable seal connection through the cylindrical hinge; and a semi-spherical cavity formed by the upper end surface and the spherical inner cavity of the turntable 2 is divided into a V1 workroom 1000 and a V2 workroom 1001.

The main shaft 4 drives the turntable 2 when rotating, and the turntable 2 drives the piston 1 to move (in the drawing, for the rotation direction of the main shaft 4, the main shaft 4 rotates clockwise seen from the cylinder head 6); the movement of the piston 1 is the unique rotation around its own axis; the movement of the turntable 2 synthesizes two movements: the first movement is rotation around its own axis; the other movement is that the axis always passes through the spherical center of the spherical inner cavity, and makes circumferential movement on a virtual conical surface having the spherical center of the spherical inner cavity as a vertex, having a conical angle of 2.alpha. and having an axis coincident with the axis of the main shaft 4 (i.e., the axis of the turntable 2 passes through the conical surface of the above cone); the movement cycle is synchronous with the rotation cycle of the main shaft 4; the above movements of a spatial mechanism are rotating movements, so no high-vibration movement part exists; the synthesis result of such spatial movements is: the piston 1 and the turntable 2 have a periodic relative swing; the swing cycle is one time the rotation cycle of the main shaft, and the swing amplitude is 4.alpha.; such relative swing is used as a basic movement element of volume change to form a V1 workroom 1000 and a V2 workroom 1001 with alternatively changed pressure; as shown in FIG. 1, FIG. 2, FIG. 5 and FIG. 6, intake and exhaust ports 101 are arranged in the piston 1; an intake passage 601 and an exhaust passage 602 are arranged on the inner spherical surface of the cylinder head 6; the structure is shown in FIG. 5 and FIG. 6: the intake passage 601 is connected with an inlet joint 15 outside the cylinder head through the intake hole 604 outside a communication cylinder; an internal thread is arranged on the intake hole 604 which is connected with the inlet joint 15 through the thread; the exhaust passage 602 is connected with an outlet joint 16 through the exhaust hole 605 outside the communication cylinder on the cylinder head 6; an internal thread is arranged on the exhaust hole 605 which is connected with the outlet joint 16 through the thread; through the rotation of the piston 1 and the fit of the spherical surface of the piston 1 with the semi-spherical inner surface of the cylinder head 6, as basic movement elements of opening and closing all the intake and exhaust ports, intake and exhaust control can be realized by opening and closing the intake and exhaust ports 101 as well as the intake passage 601 and the exhaust passage 602.

A core technology of the present invention is as follows: a spherical rotating body space adopting the turntable shaft 203 as a rotating axis is formed between the cylinder 8 and the cylinder block 9; a pin boss 26 is arranged in the spherical rotating body space; the pin boss 26 is fixedly connected to the turntable shaft 203 and rotates along with the turntable shaft 203 in the rotating body space; a pin hole is formed in the pin boss 26; one end of each guide pin 27 is inserted into the pin hole to be fixed; the portion, extending out of the pin boss 26, on the other end of each guide pin 27 is movably connected with a guide sleeve 28; the guide sleeve 28 can rotate freely on the guide pin 27; a concave slideway 902 is arranged on the cylinder block spherical surface 903 or the cylinder lower spherical surface 802 at the same side of the guide sleeves 28; the concave slideway 902 is distributed on a slide track of the cylinder block spherical surface 903 or the cylinder lower spherical surface 802 at the same side of the guide sleeves 28 in the rotation process of the turntable 2; the cross-sectional shape of the concave slideway 902 is adaptive to the shape of the guide sleeves 28; and the guide sleeves 28 are located in the concave slideway 902.

As a specific example of the present embodiment, as shown in FIG. 2, FIG. 8, FIG. 9 and FIG. 12, in the present embodiment, the guide sleeves 28 are arranged at one side of the cylinder block 9 on the pin boss 26, and the concave slideway 902 is arranged on the cylinder block spherical surface 903; a cylinder block shaft hole 901 penetrates through the center of the cylinder block spherical surface 903; a spherical bottom surface, i.e. the cylinder lower spherical surface 802 is protruded out of the lower portion of the cylinder 8, and a cylinder shaft hole 801 penetrates through the center of the cylinder lower spherical surface 802; the turntable shaft 203 of the turntable 2 penetrates through the cylinder shaft hole 801 and the cylinder block shaft hole 901, the end part of the turntable shaft 203 is inserted into an eccentric shaft hole 401 of the main shaft 4, and a square step is arranged in the middle of the turntable shaft 203; the pin boss 26 is in an arc shape, and the center of the arc is identical to the spherical center of the turntable spherical surface; pin holes are symmetrically arranged in two ends of the arc of the pin boss 26 by adopting the turntable shaft 203 as a symmetric axis, the two guide pins 27 are respectively inserted into the pin holes to be fixed, and the two guide pins 27 are respectively and symmetrically arranged in two sides of the pin boss 26; the portion, extending out of the pin boss 26, of each guide pin 27 is movably connected with the guide sleeves 28, a square hole is formed in the center of the arc of the pin boss 26, and the pin boss 26 is fixed on the square step in the middle of the turntable shaft 203 through the square hole; the guide sleeves 28 are sunk in the concave slideway 902, and along with the rotation of the turntable 2, the guide sleeves 28 slide in the concave slideway 902 and also can rotate on the guide pins 27; the pin boss 26 rotates along with the turntable shaft 203 in the spherical rotating body space, a movable clearance is respectively reserved between the upper portion of the pin boss 26 and the cylinder lower spherical surface 802 and between the lower portion of the pin boss 26 and the cylinder block spherical surface 903, and the size of each clearance is appropriate under the condition that the pin boss 26 does not interfere with the cylinder lower spherical surface 802 and the cylinder block spherical surface 903 in the rotation process.

Figure 14:
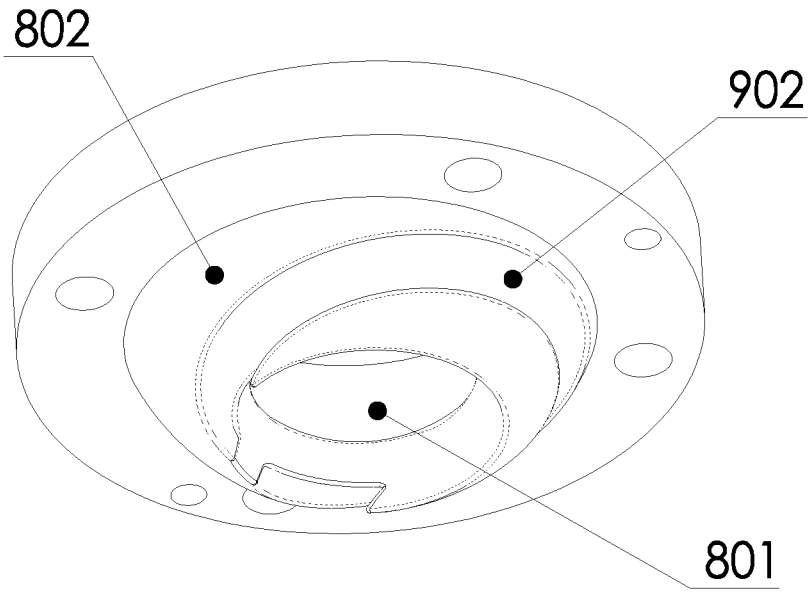
FIG. 14 is a stereoscopic structural diagram of a cylinder when a concave slideway is on a cylinder lower spherical surface.

As another specific example of the present embodiment, as shown in FIG. 15, the guide sleeves 28 are located at one side of the cylinder 8 on the pin boss 26; when in assembling, the guide sleeves 28 are first sleeved on the guide pins 27, then the small end of each guide pin 27 is installed into the pin hole of the pin boss 26, and by means of the axial limiting of the step at the large end of each guide pin 27, the guide sleeves 28 only can rotate circumferentially around the axes of the guide pins 27 on the guide pins 27 and cannot move axially along the axes of the guide pins 27; the square hole is formed in the middle of the pin boss 26, and the pin boss 26 is fixed on the square step in the middle part of the turntable shaft 203 through the square hole; and as shown in FIG. 14, in the present embodiment, the concave slideway 902 is arranged on the cylinder lower spherical surface 802.

The operation process of the anti-locking mechanism of the spherical compressor rotor of the present invention is as follows: in the rotation process of the main shaft 4, and before the turntable axis and the piston axis are superposed, the guide sleeves 28 are just arranged in the concave slideway 902, and continue to slide along its own movement track in the concave slideway 902 along with the rotation of the turntable 2; the guide sleeves 28 are arranged in the concave slideway 902; the turntable 2 and the piston 1 have a relative swinging trend under the effect of the main shaft 4; such trend may result in an extrusion force F between the concave slideway 902 and the guide sleeves 28, and its stress state is shown in FIG. 13; and the force F generates a component force F1 in the rotation direction of the turntable 2, and under the effect of the force F1, the turntable 2 acquires a torque of rotating around the turntable axis to continue to rotate, so that even if the piston axis and the turntable axis are superposed, the component force still exists, i.e. at the dead point position, the turntable 2 is pushed by the component force to continue to rotate.

The anti-locking mechanism of the spherical compressor rotor of the present invention is suitable for a single-level compression structure of a basic structural type and is also suitable for a multilevel compression structure.

As shown in FIG. 2, in order to reduce the frictional resistance in the rotation of the rotor, reduce the abrasion of the rotor component, maintain the high-precision, lasting and efficient rotation and prolong the service life of the spherical compressor, a cylinder block bushing 13 is additionally arranged on the portion on which the main shaft 4 is matched with the lower cylinder of the cylinder block 9, a turntable shaft sleeve 12 is additionally arranged on the portion on which the turntable shaft 203 is matched with the eccentric shaft hole 401 of the main shaft 4, and a support bushing 14 is additionally arranged on the portion on which the main shaft 4 is matched with the cylinder of the main shaft support 7; and the cylinder block bushing 13, the turntable shaft sleeve 12 and the support bushing 14 are made of wear-resistant materials. A sealing groove is formed in the main shaft 4, and a sealing ring 22 is additionally arranged on the portion on which the main shaft 4 is matched with the main shaft support 7.

As shown in FIG. 16 and FIG. 17, the spherical compressor provided in some other embodiments of the present invention comprises a piston 1, a turntable 2, a center pin 3, a main shaft 4, a cylinder head 6, a cylinder 8, a cylinder block 9 and a main shaft support 7, wherein the cylinder head 6, the cylinder 8, the cylinder block 9 and the main shaft support 7 are connected with one another successively through connecting screws 23 to form a casing of the spherical compressor; and as shown in FIG. 20, FIG. 21 and FIG. 22, the cylinder head 6 and the cylinder 8 are provided with semi-spherical inner surfaces, the semi-spherical inner surfaces are connected with one another through the connecting screws 23 to form a spherical inner cavity of the spherical compressor, the cylinder block 9 is connected to the lower portion of the cylinder 8 through the connecting screw 23, and in order to guarantee the matching and positioning accuracy of all spherical surfaces, positioning pins 21 are configured on the junctions of the cylinder head 6, the cylinder 8 and the cylinder block 9.

Figure 31:
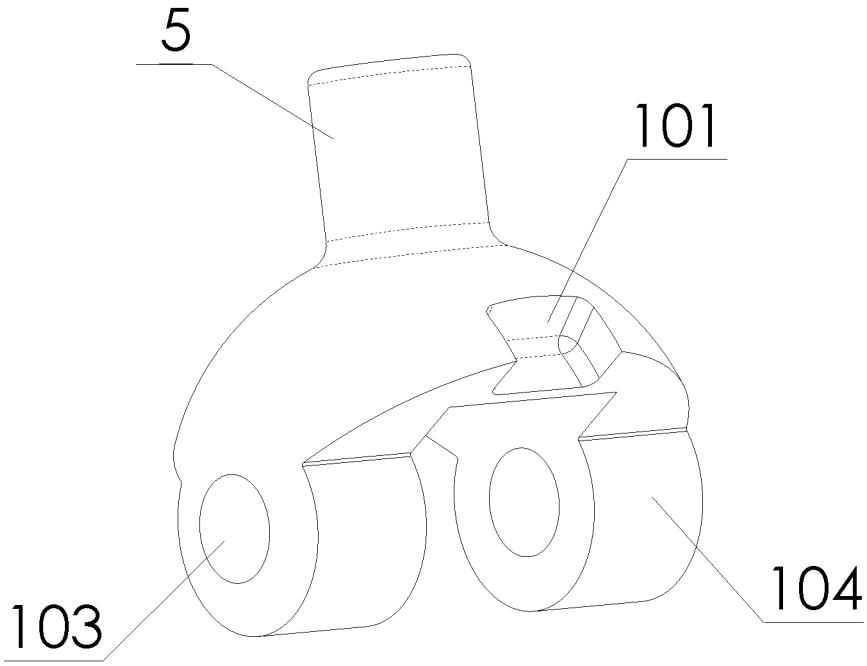
FIG. 31 is a structural diagram of a piston of connecting a piston shown in FIG. 18 with a piston shaft into a whole.

As shown in FIG. 18, the piston 1 has a spherical top surface, and the center of the spherical top surface is provided with one piston shaft hole 102, two angled side surfaces, intake and exhaust ports 101 and a piston pin boss 104 formed on the lower part of the two side surfaces of the piston 1; two intake and exhaust ports 101 are symmetrically distributed in the middle of half round edges of the two side surfaces of the piston 1; the piston pin boss 104 is a half-cylinder structure; grooves are arranged in the middle of the half-cylinder; perforated piston pin holes 103 are arranged in the axial direction of the half-cylinder; as shown in FIG. 20 and FIG. 21, a cylinder head end shaft hole 603 is arranged in the cylinder head 6; a hole seat of the cylinder head end shaft hole 603 is protruded from the cylinder head 6; the shaft diameter size of the shaft end of the piston shaft 5 is matched with the piston shaft hole 102; referring to FIG. 17, the shaft end of the piston shaft 5 is inserted into the piston shaft hole 102; the other end of the piston shaft 5 is matched with the inner hole of the cylinder head end shaft hole 603 to form rotating fit; the internal thread of the threaded seal head 25 is matched with the external thread on an outer circle, wherein the external thread is arranged on the cylinder head end shaft hole 603 and is protruded from the cylinder head; the piston shaft 5 is axially limited through the threaded seal head 25 and performs the effect of sealing; the piston 1 can freely rotate around the axis of the piston shaft 5 in the spherical inner cavity; and the spherical top surface of the piston and the semi-spherical inner cavity have the same spherical center and form movable seal fit. Of course, the piston 1 and the piston shaft 5 can also be made into an integrated structure, as shown in FIG. 31.

As shown in FIG. 19, a turntable shaft 203 extends from the center of the lower end surface of the turntable 2; a turntable spherical surface exists on a peripheral surface between the upper part and the lower end surface of the turntable 2; the spherical inner cavity formed by the cylinder 8 and the cylinder head 6 has the same spherical center with the turntable spherical surface; the turntable spherical surface is close to the spherical inner cavity to form movable seal fit; a turntable pin boss 201 is arranged on the upper part of the turntable 2 relative to the piston pin boss 104; half-cylinder grooves are arranged on both ends of the turntable pin boss 201, and a protruded half-cylinder is arranged in the middle; and a perforated turntable pin hole 202 is arranged in the axial direction of the half-cylinder. Of course, the turntable shaft 203 can also be made into an independent shaft; as shown in FIG. 32, an installation square hole of the turntable shaft 203 is arranged in the position connected with the turntable shaft 203 on the turntable 2; the shape of one end of the turntable shaft 203 connected with the turntable 2 is a square structure matched therewith; and the square end of the turntable shaft 203 is inserted into the installation square hole of the turntable shaft and then circumferentially fixed.

Figure 25:
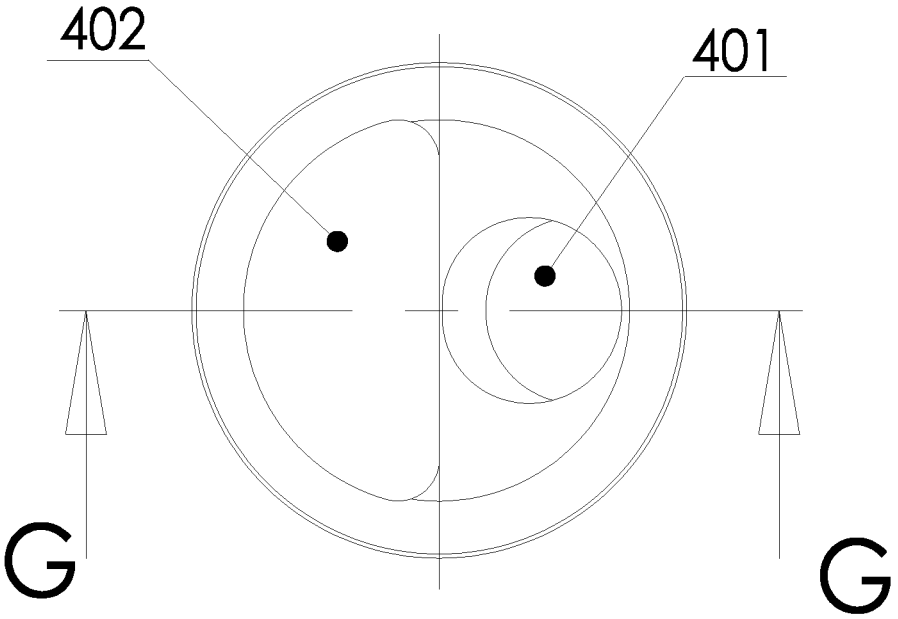
FIG. 25 is a top structural diagram of a main shaft in a spherical compressor shown in FIG. 17.
Figure 26:
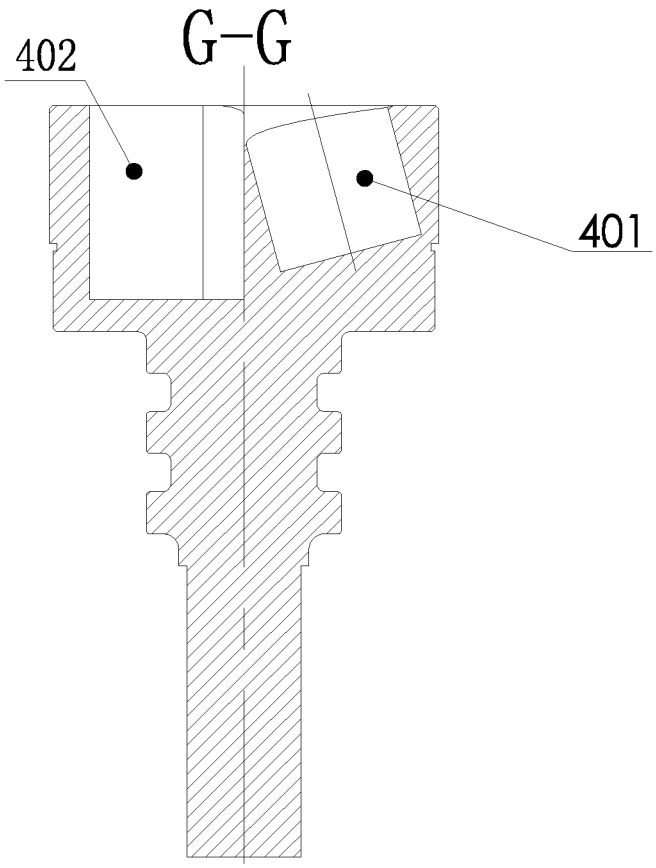
FIG. 26 is a sectional structural diagram of G-G section in a main shaft shown in FIG. 25.

As shown in FIG. 17, the center pin 3 is inserted into the piston pin boss 104 and the turntable pin boss 201; a cylinder shaft hole 801 and a cylinder block shaft hole 901 through which the turntable shaft 203 pass are arranged in the cylinder 8 and the cylinder block 9; the main shaft support 7 is connected with the cylinder block 9 through a connecting screw 23 to provide support for the rotation of the main shaft 4; as shown in FIG. 17, FIG. 25 and FIG. 26, an eccentric shaft hole 401 and a balance block 402 are arranged on one end of the main shaft 4; the end part of the main shaft 4 is located in the cylindrical cavity under the cylinder block 9 and connected with the turntable shaft 203; the other end is connected with a power mechanism to provide power for capacity change of a compressor; the balance block 402 is used for regulating the unbalanced force of the main shaft 4 during rotation; a regulating pad 11 is arranged on the contact part between the upper end surface of the main shaft 4 and the lower bottom surface of the cylinder block 9, for regulating the height of the main shaft 4 during assembly; the axes of the above piston shaft 5, the turntable shaft 203 and the main shaft 4 pass through the spherical center of the spherical inner cavity formed by the cylinder 8 and the cylinder head 6; the axis of the piston shaft 5 and the axis of the turntable shaft 203 form the same inclined angle .alpha. with the axis of the main shaft 4; the center pin 3 is inserted into the piston pin hole 103 of the piston 1 and the turntable pin hole 202 of the turntable 2 to form the cylindrical hinge; the piston 1 and the turntable 2 form movable seal connection through the cylindrical hinge; and a semi-spherical cavity formed by the upper end surface and a spherical inner cavity of the turntable 2 is divided into a V1 workroom 1000 and a V2 workroom 1001.

To reduce frictional resistance in rotor operation, reduce the abrasion of rotor parts, keep high-precision, persistent and efficient operation and increase the life of the spherical compressor, a cylinder block bushing 13 is added on the matching part of the main shaft 4 and the lower cylinder of the cylinder block 9; a turntable shaft sleeve 12 is added on the matching part of the turntable shaft 203 and the eccentric shaft hole 401 of the main shaft 4; a support bushing 14 is added on the matching part of the main shaft 4 and the cylinder of the main shaft support 7; a piston shaft bushing 20 is added on the matching part of the piston shaft 5 and the cylinder head end shaft hole 603; and the cylinder block bushing 13, the turntable shaft sleeve 12, the support bushing 14 and the piston shaft bushing 20 are made of abrasion-proof materials. A seal groove is arranged on the main shaft 4, and a seal ring 22 is added on the matching part of the main shaft 4 and the main shaft support 7.

The main shaft 4 drives the turntable 2 when rotating, and the turntable 2 drives the piston 1 to move (in the drawing, for the rotation direction of the main shaft 4, the main shaft 4 rotates clockwise seen from the cylinder head 6); the movement of the piston 1 is the unique rotation around the axis of the piston shaft 5; the movement of the turntable 2 synthesizes two movements: the first movement is rotation around its own axis; the other movement is that the axis always passes through the spherical center of the spherical inner cavity, and makes circumferential movement on a virtual conical surface having the spherical center of the spherical inner cavity as a vertex, having a conical angle of 2.alpha. and having an axis coincident with the axis of the main shaft 4 (i.e., the axis of the turntable 2 passes through the conical surface of the above cone); the movement cycle is synchronous with the rotation cycle of the main shaft 4; the above movements of a spatial mechanism are rotating movements, so no high-vibration movement part exists; the synthesis result of such spatial movements is: the piston 1 and the turntable 2 have a periodic relative swing; the swing cycle is one time the rotation cycle of the main shaft, and the swing amplitude is 4.alpha.; such relative swing is used as a basic movement element of volume change to form a V1 workroom 1000 and a V2 workroom 1001 with alternatively changed pressure; as shown in FIG. 16, FIG. 17, FIG. 20 and FIG. 21, intake and exhaust ports 101 are arranged in the piston 1; an intake passage 601 and an exhaust passage 602 are arranged on the inner spherical surface of the cylinder head 6; the structure is shown in FIG. 20 and FIG. 21: the intake passage 601 is connected with an inlet joint 15 outside the cylinder head through the intake hole 604 outside a communication cylinder; an internal thread is arranged on the intake hole 604 which is connected with the inlet joint 15 through the thread; the exhaust passage 602 is connected with an outlet joint 16 through the exhaust hole 605 outside the communication cylinder on the cylinder head 6; an internal thread is arranged on the exhaust hole 605 which is connected with the outlet joint 16 through the thread; through the rotation of the piston 1 and the fit of the spherical surface of the piston 1 with the semi-spherical inner surface of the cylinder head 6, as basic movement elements of opening and closing all the intake and exhaust ports, intake and exhaust control can be realized by opening and closing the intake and exhaust ports 101 as well as the intake passage 601 and the exhaust passage 602.

The core technology of the present invention is as follows: the turntable synchronizing power mechanism is formed between the cylinder 8 and the cylinder block 9, the backpressure support is formed on the turntable, and the compressor is cooled and lubricated.

Figure 23:
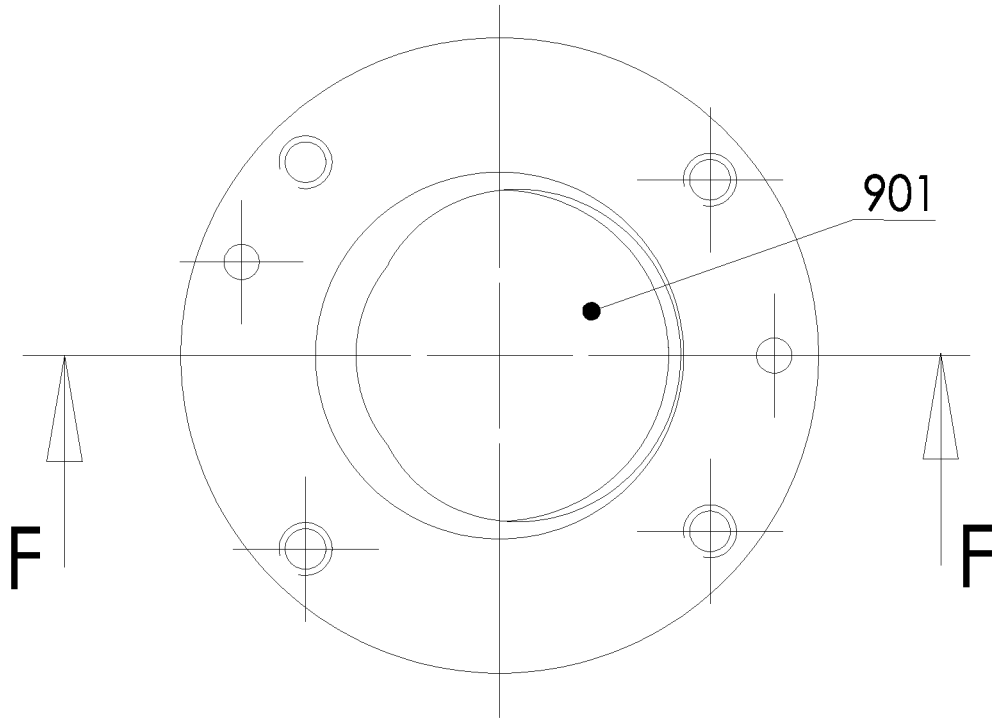
FIG. 23 is a top structural diagram of a cylinder block in a spherical compressor shown in FIG. 17.
Figure 24:
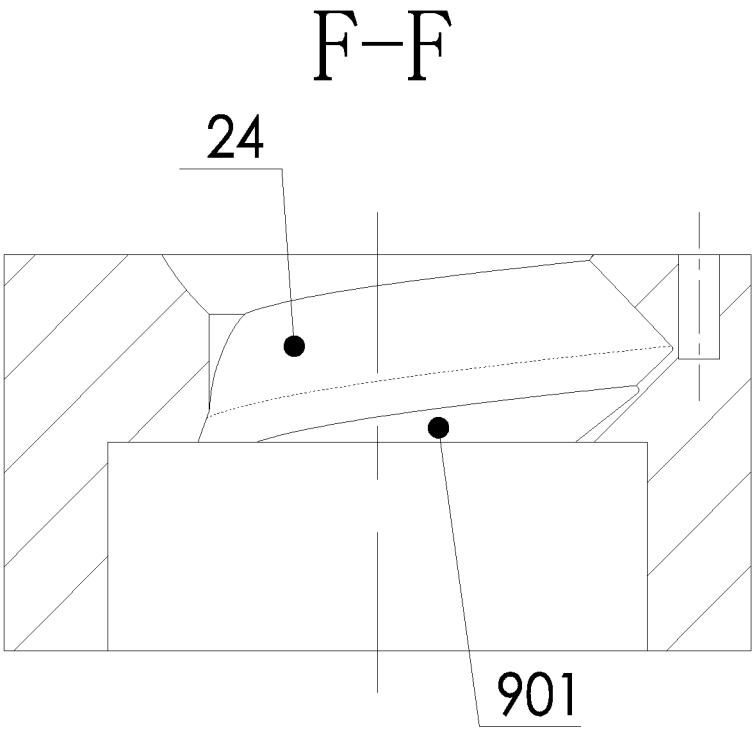
FIG. 24 is a sectional structural diagram of F-F section in a cylinder block shown in FIG. 23.

As shown in FIG. 17, FIG. 23 and FIG. 24, the turntable synchronizing power mechanism is composed of the power handle 10 and the track limiting surface 24, wherein the power handle 10 is of a dumbbell structure with two symmetric ends, the power handle 10 is fixed on the turntable shaft 203 and rotates together with the turntable 2, and the movement track surfaces at two ends of the power handle 10 contacted with the cylinder block 9 in the rotating process form the track limiting surface 24; and the power handle 10 rotates together with the turntable 2, and the rotating body space is formed between the cylinder 8 and the cylinder block 9, so that a sufficient space guaranteeing the free rotation of the power handle 10 is reserved between the cylinder 8 and the cylinder block 9.

The power handle 10 can be made into various structural forms as follows:

A first structure of the power handle is as follows: as shown in FIG. 27, two ends of the power handle 10 are in a form of slip shoes, a square installation hole is formed in the middle of the power handle 10, a square step matched with the installation hole is arranged in the middle of the turntable shaft 203, the power handle 10 is fixed on the square step of the turntable shaft 203 through the installation hole, two ends of the power handle 10 are fixedly connected with the arc slip shoes 18, and when the power handle 10 rotates, the slip shoes 18 slide in a manner of fitting to the track limiting surface 24; the slip shoes 18 are made of PEEK, copper or other elastic wear-resistant materials and are fixed at two ends of the power handle 10 in a riveting manner or in a bolt connection manner; and the slip shoes 18 are symmetric about the axis of the turntable shaft 203.

A second structure of the power handle is as follows: as shown in FIG. 28, two ends of the power handle 10 are provided with pulleys 19, a square installation hole is formed in the middle of the power handle 10, a square step matched with the installation hole is arranged in the middle of the turntable shaft 203, the power handle 10 is fixed on the square step of the turntable shaft 203 through the square installation hole, the pulleys 19 rotate in a manner of fitting to the track limiting surface 24, and the two pulleys 19 are symmetric about the axis of the turntable shaft 203.

A third structure of the power handle is as follows: as shown in FIG. 29, a square installation hole is formed in the middle of the power handle 10, a square step matched with the installation hole is arranged in the middle of the turntable shaft 203, the power handle 10 is fixed on the square step of the turntable shaft 203 through the square installation hole, two ends of the power handle 10 are of an arc structure, the arcs at two sides are symmetric about the axis of the turntable shaft 203, the arcs have no slip shoe 18 or pulley 19 fixedly connected, and in the rotating process of the power handle 10, the arcs at two sides slide in a manner of contacting the track limiting surface 24; in order to improve the wear resistance and the matched flexibility, as shown in FIG. 34, the insert 17 which is made of the PEEK, copper or other elastic wear-resistant materials is arranged on the track limiting surface 24 contacted with two ends of the power handle 10; the insert 17 is arranged in an autorotation travel range in which the power handle 10 is contacted with the track limiting surface 24 when the power handle 10 rotates to a position nearby the dead point of the mechanism; and as shown in FIG. 34, the track limiting surface 24 is arranged on the cylinder block 9, the insert 17 is made of the PEEK and is fixed on the cylinder block 9 in a mechanical embedding manner, and the surface of the insert 17 forms one part of the track limiting surface 24.

In the embodiment, the installation hole in the middle of the power handle 10 is a square hole, the power handle 10 is fixedly installed on the square step of the turntable shaft 203 through the square hole, the square step of the turntable shaft 203 is arranged between the cylinder 8 and the cylinder block 9, and in real application, a circular hole with a key slot or a spline groove can be formed in the middle of the power handle 10, and the corresponding portion of the turntable shaft 203 is a circular shaft with a key slot or a spline.

The turntable shaft 203 can be made into an independent structure independent from the turntable 2; as shown in FIG. 30 and FIG. 32, a turntable shaft installation square hole is formed in the portion connected with the turntable shaft 203 on the turntable 2, the shape of one end of the turntable shaft 203 connected with the turntable 2 is a square structure matched therewith, and the square end of the turntable shaft 203 is inserted into the turntable shaft installation square hole and then is circumferentially fixed; the power handle 10 is arranged in the middle of the turntable shaft 203 and manufactured into an integral component with the turntable shaft 203; the other end of the turntable shaft 203 is a circular shaft end and is inserted into the eccentric shaft hole 401 of the main shaft; as shown in FIG. 30, two ends of the power handle 10 are provided with slip shoes 18; and in real application, two ends of the power handle 10 can also be pulleys 19, or two ends of the power handle 10 are neither slip shoes 18 nor pulleys 19, but are in arc body shape, and at the same time, the corresponding track limiting surface is provided with the elastic wear-resistant insert 17.

Two ends of the power handle 10 are provided with the magnetic materials; the track limiting surface 24 is fixedly provided with the magnetic insert; the opposite surfaces of the magnetic insert on the track limiting surface 24 and the magnetic materials on the power handle 10 have the same magnetic poles, and after assembly, a certain clearance is formed between the magnetic materials at two ends of the power handle 10 and the magnetic insert on the track limiting surface 24; the magnetic insert is fixed on the track limiting surface 24 on the cylinder block 9 in a mechanical embedding manner, and the magnetic insert is located in the travel range when the power handle 10 rotates to a position nearby the dead point of the mechanism and when two ends of the power handle 10 are close to the track limiting surface 24; and in this way, when the turntable 2 rotates to a position nearby the dead point, the magnetic materials on the power handle 10 are close to the magnetic insert on the track limiting surface 24, a repellent magnetic force is generated due to the identical polarity of the magnetic poles, and the magnetic force is used as the rotation power to drive the power handle 10 to rotate continuously. The magnetic inset and the magnetic materials on two ends of the power handle 10 can be permanent magnets, and can also be electromagnetic materials.

The track limiting surface 24 can be a whole track or a partial track in which two ends of the power handle 10 are respectively contacted with the cylinder block 9 in the rotation process of the turntable 2; and if the track limiting surface is the partial track, the partial track can be contacted with two ends of the power handle 10 when the turntable 2 rotates to the position on which the turntable axis and the piston axis are superposed, i.e. nearby the position of the dead point of the mechanism.

A first way for configuring the backpressure support on the turntable is as follows: the backpressure groove is formed in a portion which is always contacted with the turntable spherical surface on the cylinder inner spherical surface in the movement process; the cylinder head 6 and the cylinder 8 are provided with backpressure air passages which are mutually communicated; the backpressure air passage on the cylinder head 6 is communicated with the exhaust passage 602 on the cylinder head 6; the backpressure air passage on the cylinder 8 is communicated with the backpressure groove; high-pressure gas or liquid in the exhaust passage enters the backpressure groove through the backpressure air passages to form the backpressure support on the turntable spherical surface; the backpressure groove can be a local groove, or a continuous annular groove in the rotation cycle of the turntable 2; and when the turntable 2 rotates to any position, the backpressure groove shall be located on the portion on which the turntable spherical surface is contacted (matched) with the cylinder spherical surface.

A second way for configuring the backpressure support on the turntable is as follows: the cylinder head 6, the cylinder 8 and the cylinder block 9 are provided with backpressure air passages which are communicated; the backpressure air passage on the cylinder head 6 is connected with the exhaust passage 602; the outlet of the backpressure air passage on the cylinder block 9 is arranged on the inner surface of the cylinder block 9 forming a rotating space in which the power handle 10 rotates around the turntable shaft 203; high-pressure gas or liquid discharged from the exhaust passage enters the rotating space of the power handle 10 successively through the backpressure air passages of the cylinder head 6, the cylinder 8 and the cylinder block 9 to form the integral backpressure support on the lower portion of the turntable 2; and the cylinder block 9, the cylinder 8 and the cylinder head 6 are also provided with gas return passages which are communicated with one another, the inlet of each gas return passage is formed in the cylinder block 9 inner surface forming the power handle 10 rotating space on the cylinder block 9, and the outlet of each gas return passage can be arranged on the cylinder head 6 and is communicated with the exhaust hole 605.

The operation process of the anti-locking power mechanism of the spherical compressor in the present invention is as follows: before the turntable axis and the piston axis are superposed in the rotation process of the main shaft 4, two ends of the power handle 10 are just contacted with the track limiting surface 24 and slide along its own movement track on the track limiting surface 24 along with the rotation of the turntable 2, so that under the effect of the main shaft 4, the turntable 2 and the piston 1 have a relative swinging trend; such trend results in an extrusion force F between the track limiting surface 24 and the power handle 10, and its stress state is shown in FIG. 33; and the force F generates a component force F1 in the rotation direction of the turntable 2, and under the effect of the force F1, the turntable 2 acquires a torque of rotating around the turntable axis to rotate continuously, so that under the situation that the piston axis and the turntable axis are superposed, the component force still exists and becomes the autorotation power when the turntable rotates to the position of the dead point, i.e. at the dead point position, the component force pushes the turntable 2 to rotate continuously. Meanwhile, since the backpressure support is formed on the turntable spherical surface, the local pressure generated by the turntable spherical surface on the cylinder spherical surface due to the formation of the high pressure operation chamber is balanced, thereby reducing the frictional force between the turntable 2 and the cylinder 8, and preventing the rotor from being locked in the rotation process.

In the above first backpressure support way, the cooling and lubrication way is adopted as follows: the cylinder 8 and the cylinder block 9 are provided with the intake lead-in passages which are communicated, the inlet of each intake lead-in passage is arranged on the outer side wall of the cylinder 8, and the outlet of each intake lead-in passage is communicated with the rotating space of the power handle 10; the cylinder block 9, the cylinder 8 and the cylinder head 6 are provided with the intake return passages which are successively communicated, the outlet of each intake return passage is connected with the intake hole 604 of the compressor, and the inlet of each intake return passage is communicated with the rotating body space of the power handle 10; the intake lead-in passage and the intake return passage on the cylinder block 9 are communicated to a bearing portion on which the main shaft 4 is matched with the cylinder block bushing 13 and a bearing portion on which the main shaft support 7 is matched with the main shaft 4 to form lubricating and cooling passages for the compressor; before the compression, the low-pressure low-temperature gas or liquid enters the bearing portion on which the cylinder block bushing 13 is matched with the main shaft 4 through the intake lead-in passage, and also can enter the bearing portion on which the main shaft support 7 is matched with the main shaft 4 so as to lubricate and cool the bearing portions; the low-pressure low-temperature gas or liquid enters the rotating body space of the power handle 10 through the intake lead-in passage to cool and lubricate the mechanism; and such low-temperature low-pressure gas or liquid is finally returned to the intake hole 604 of the compressor through the intake return passage and is used as the working medium to realize further compression.

In the above second backpressure support way, the backpressure air passage and the gas return passage on the cylinder block 9 are communicated to the bearing portion on which the main shaft 4 is matched with the cylinder block bushing 13 and the bearing portion on which the main shaft support 7 is matched with the main shaft 4 to form a lubricating and cooling passage for the compressor. The cooling and the lubrication are realized by means of the compressed gas or liquid.

The anti-locking power mechanism of the spherical compressor of the present invention is suitable for the single-level compression structure of the basic structural type, and also suitable for the multilevel compression structure.

The detail descriptions of the above embodiments only aim at explaining the present invention to make the present invention better understood; however, these descriptions cannot be interpreted as the limitation to the present invention in any reason; particularly, all features described in different embodiments can also be combined arbitrarily to form other embodiments; and except for the features with definitely opposite descriptions, it shall be understood that these features can be applied to any embodiment, but not limited to the described embodiments.

What is claimed is:

1. An anti-locking mechanism of a spherical compressor rotor, characterized in that a cylinder block (9) is fixedly connected between a cylinder (8) and a main shaft support (7), and a cylinder block spherical surface (903), a cylinder lower spherical surface (802) and a turntable spherical surface have a same spherical center; a spherical diameter of the cylinder block spherical surface (903) is greater than that of the cylinder lower spherical surface (802), and a spherical rotating body space surrounding a turntable shaft (203) is formed between the cylinder (8) and the cylinder block (9); the turntable shaft (203) penetrates through a cylinder shaft hole (801) and a cylinder block shaft hole (901), and the end part of the turntable shaft (203) is inserted into an eccentric shaft hole (401) of a main shaft (4); a pin boss (26) is fixed on the turntable shaft (203) and rotates in the spherical rotating body space along with the turntable shaft (203), guide pins (27) are fixedly arranged on the pin boss (26), and an extension portion of each of the guide pins (27) is movably connected with a guide sleeve (28); a concave slideway (902) is arranged on the cylinder block spherical surface (903) or the cylinder lower spherical surface (802), and is distributed along a sliding track of the guide sleeve (28) on the corresponding cylinder block spherical surface (903) or the cylinder lower spherical surface (802) in a rotation process of a turntable (2); and the guide sleeve (28) is located in the concave slideway (902), and a cross sectional shape of the concave slideway (902) is matched with a shape of the guide sleeve (28).

2. The anti-locking mechanism of the spherical compressor rotor of claim 1, characterized in that the guide sleeve (28) is arranged at one side of the cylinder block (9) on the pin boss (26), and the concave slideway (902) is arranged on the cylinder block spherical surface (903).

3. The anti-locking mechanism of the spherical compressor rotor of claim 1, characterized in that the guide sleeve (28) is arranged at one side of the cylinder (8) on the pin boss (26), and the concave slideway (902) is arranged on the cylinder lower spherical surface (802).

4. The anti-locking mechanism of the spherical compressor rotor of claim 1, characterized in that the pin boss (26) is in an arc shape, and the guide pins (27) are arranged at two sides of the pin boss (26) symmetrically by adopting the turntable shaft (203) as a symmetric shaft.

* * * * *